US012193574B2

(12) United States Patent
Polevoy et al.

(10) Patent No.: US 12,193,574 B2
(45) Date of Patent: Jan. 14, 2025

(54) FOLDING BED FRAME

(71) Applicant: FINGER LAKES INTELLECTUAL PROPERTY, LLC, Teaneck, NJ (US)

(72) Inventors: Richard S. Polevoy, Teaneck, NJ (US); Paul E. Carlson, Skaneateles, NY (US); Robert L. Naas, Skaneateles, NY (US); Kurt R. Werner, Auburn, NY (US); Michael W. Konieczny, Skaneateles, NY (US)

(73) Assignee: FINGER LAKES INTELLECTUAL PROPERTY, LLC, Teaneck, NJ (US)

( * ) Notice: Subject to any disclaimer, the term of this patent is extended or adjusted under 35 U.S.C. 154(b) by 0 days.

(21) Appl. No.: 15/514,291

(22) PCT Filed: Jun. 2, 2016

(86) PCT No.: PCT/US2016/035422
§ 371 (c)(1),
(2) Date: Mar. 24, 2017

(87) PCT Pub. No.: WO2016/196731
PCT Pub. Date: Dec. 8, 2016

(65) Prior Publication Data

US 2017/0273468 A1 Sep. 28, 2017

Related U.S. Application Data

(60) Provisional application No. 62/169,861, filed on Jun. 2, 2015.

(51) Int. Cl.

| | |
|---|---|
| ***A47C 19/12*** | (2006.01) |
| ***A47C 19/00*** | (2006.01) |
| ***A47C 19/04*** | (2006.01) |

(52) U.S. Cl.
CPC ..... *A47C 19/12* (2013.01); *A47C 19/005* (2013.01); *A47C 19/04* (2013.01); *A47C 19/124* (2013.01)

(58) Field of Classification Search
CPC ..... A47C 19/12; A47C 19/04; A47C 19/045; A47C 19/024; A47C 19/021; A47C 23/00;
(Continued)

(56) References Cited

U.S. PATENT DOCUMENTS 723,569 A * 3/1903 Witzel ..... F16B 12/58 5/287
1,823,768 A * 9/1931 Secunda ..... A47D 7/002 5/154
(Continued)

*Primary Examiner* — Justin C Mikowski
*Assistant Examiner* — Amanda L Bailey
(74) *Attorney, Agent, or Firm* — Hoffmann & Baron, LLP

(57) ABSTRACT

A bed frame that can be assembled without the use of tools. The bed frame can also be easily collapsed into a relatively compact package since the normal long side rails are comprised of two components that can be manipulated such that the two components can be in an end to end orientation when the side rails used in a bed frame or in a generally side by side orientation to facilitate shipping and storage. The cross rails can also be formed of two components that can be moved between an end to end orientation and a generally parallel orientation. A locking system locks certain of the components into a fixed position when in the end to end orientation.

8 Claims, 40 Drawing Sheets

(58) Field of Classification Search
CPC ..... A47C 23/005; A47D 7/00; A47D 7/002; A47D 7/005; A47D 7/01; F16B 12/54; F16B 12/56; F16B 12/58; F16B 12/60
See application file for complete search history.

(56) References Cited

U.S. PATENT DOCUMENTS

| | | | | | |
|---|---|---|---|---|---|
| 1,851,282 | A * | 3/1932 | Jacobs | F16B 12/60 | 5/286 |
| 2,962,170 | A * | 11/1960 | Best | A47B 47/027 | 211/182 |
| 3,646,623 | A * | 3/1972 | Harris | A47C 19/04 | 248/408 |
| 3,744,068 | A * | 7/1973 | Harris | A47C 19/04 | 248/408 |
| 5,577,280 | A * | 11/1996 | Elliott | A47C 19/005 | 5/617 |
| 5,694,656 | A * | 12/1997 | Huang | A47C 19/005 | 297/440.1 |
| 5,906,014 | A | 6/1999 | Zhuang | | |
| 6,941,596 | B2 * | 9/2005 | Schuman | A47C 19/024 | 5/200.1 |
| 8,220,086 | B2 * | 7/2012 | Geiger | A47C 19/02 | 5/201 |
| 8,850,638 | B1 * | 10/2014 | Suh | A47C 19/022 | 5/311 |
| 9,226,588 | B2 * | 1/2016 | McCarty | A47C 19/028 | |
| 9,414,690 | B2 * | 8/2016 | Harrow | A47C 19/122 | |
| 10,939,771 | B2 * | 3/2021 | Choi | A47C 19/005 | |
| 2003/0024045 | A1 * | 2/2003 | Bellows | A47C 19/005 | 5/200.1 |
| 2008/0155799 | A1 * | 7/2008 | Bartelsmeyer | A47C 19/005 | 24/457 |
| 2010/0235989 | A1 | 9/2010 | Jin | | |
| 2010/0242171 | A1 * | 9/2010 | Polevoy | A47C 19/005 | 5/282.1 |
| 2010/0269257 | A1 | 10/2010 | Connor, Jr. | | |
| 2011/0219537 | A1 * | 9/2011 | Lin | A47C 19/021 | 5/9.1 |
| 2011/0289682 | A1 * | 12/2011 | Lee | A47C 19/126 | 5/202 |
| 2012/0304380 | A1 * | 12/2012 | Jin | A47C 19/126 | 5/400 |
| 2013/0139314 | A1 * | 6/2013 | Chung | A47C 19/005 | 5/400 |

* cited by examiner

FOLDING BED FRAME

CROSS REFERENCE TO RELATED APPLICATIONS

The present application is a National Stage Application claiming the priority of PCT Application No. PCT/US2016/0354221 filed Jun. 2, 2016, which in turn, claims priority from U.S. Provisional Application Ser. No. 62/169,861 filed Jun. 2, 2015. Applicants claim the benefits of 35 U.S.C. § 120 as to the PCT Application and priority under 35 U.S.C. § 119 as to the said U.S. Provisional application, and the entire disclosures of both applications are incorporated herein by reference in their entireties.

FIELD OF THE INVENTION

The present invention relates to a bed frame for supporting a mattress or mattress set and, more particularly, to a bed frame having the ability to fold, thereby creating a compact folded bed frame package that is easy to store and transport. The bed frame has legs with receivers formed therein to allow the entire bed frame to readily be assembled without the use of tools.

BACKGROUND OF THE INVENTION

A bed frame is typically comprised of a cross rail at the head of the bed and a cross rail at the foot of the bed that connect to two parallel side rails that run along each side of the bed frame. There are normally legs elevating the cross and side rails off the floor and such legs are conventionally positioned near each of the junction points between a cross rail and a side rail. This configuration is a bed frame at its most basic configuration.

It has been recognized that, because of the increased weight of bedding and some bedding users coupled with the increased resiliency of foundations, additional center support in bed frames is required. It has become typical to add to the most basic bed frame a center cross rail and a center support leg.

By its nature, bed frame side rails are 5-6 feet long to support the length of a bed which is designed to accommodate the length of a sleeper. The cross rails are also as long as the bed is wide although in some cases the cross rails are shipped in two pieces where one end of a piece is pivotally affixed to a side rail and the free ends are affixed together at about the center of the width of the bed frame. That connection can require tools and loose hardware that can get lost.

The length of the rails causes the packaging of the disassembled frame to be quite long. This is an issue in two ways. First, the large package takes up a lot of valuable space in a retail showroom. The bed frames are typically not displayed for this reason and are stored out of sight in a warehouse. When the bed frame is not immediately visible or available to be seen by a customer, this can reduce the amount of bed frame sales.

Secondly, the long unassembled bed frame is difficult for a customer to carry home as the bed frame does not fit in a shopping cart or in a car trunk. As such, conventional bed frames are delivered to the customer in an unassembled state, and then assembled at the site where the bed frame is intended to be located and used, thereby adding to the cost of the bed frame and discouraging purchase. A bed frame that fits in a shorter box would be beneficial.

In addition, another difficulty with conventional bed frames and their assembly, however, is that tools may be required for the on-site assembly of the bed frames. If the tools are not available, the assembly cannot be done. Furthermore, tool required assemblies can be difficult and complicated.

A bed frame that has a two-piece side rail where the two pieces are pivotally attached at the mid point allows for a shorter package size. These typically require assembly hardware which can be misplaced and make assembly cumbersome.

A bed frame without loose hardware, therefore, would be beneficial. Bed frames are typically made of metal because of the rigidity and strength, but metal has sharp edges that can be dangerous or damaging. This is especially true of bed frames with folding rails as these can create dangerous pinch points. A bed frame with fewer or no exposed steel edges and pinch points would be beneficial. A bed frame that disassembles to a shorter package than a conventional frame normally will, by its nature, have more connections and attachments between components that can create locations for unwanted movement and noise.

Therefore it would be advantageous to have a bed frame that can be dissembled to form a package that is shorter than a comparable bed frame with a full length side rail. It would also be advantageous if a bed frame had no loose fasteners or sharp edges. Finally it would be advantageous to have a bed frame that has solid connections that don't rattle or squeak.

Further, it would be advantageous to provide alternative components for connections between cross rails and side rails of a bed frame that are comprised of differing materials and geometric configurations that can be used to assemble a bed frame without the need for tools.

SUMMARY OF THE INVENTION

In accordance with the present invention, there is a bed frame assembly for supporting a mattress or mattress set. The bed frame assembly is comprised of two side rails and at least one cross member where each side rail, itself, is comprised of two side rail components that are affixed together by the use of a connector that is centered over a bed frame component.

The connector itself is incorporated into the center leg of the side rails and that connection may be a drop in tool free connection or a pivoted connection. The end result, however, is that with either means, the two side rail components can be manipulated from an orientation where they are side by side to an orientation where they are end to end to make up the side rails for the bed frame without the use of tools or any additional hardware.

In a first embodiment, the center leg for the side rail is factory connected to one of the side rail components. The other side rail component can be connected to that center leg without the use of tools by the use of a receiver formed in the center leg and a wedge at the inner end of the side rail component. The side rail component can be simply dropped into receiver in the center leg to complete the connection between the two side rail components so as to make up a full length side rail for a bed frame.

The cross rail can also be supplied as two components joined together at the center by interfitting into a slot in a center cross rail leg while, again, the outer ends of the cross rail components can be attached to the side rails by a drop in connections of a small wedge into a slot in the side rail leg.

As such, the entire frame can be provided as a compact package and assembled into a completed bed frame without use of tools or other extraneous hardware.

In a second embodiment, each side rail is comprised of two side rail components where one of the side rail components is rigidly fixed to the center side rail leg and the other is pivotally affixed to the center side rail leg. As such, one of the side rail components can be pivoted about the center side rail leg from a position wherein the side rail components are positioned end to end to form the side rail of a bed frame and a second position wherein the side rail components are in a side by side position.

The cross rails may be comprised of two cross rail components joined together by a hinged connector whereby the two cross rail components can be pivoted about the hinged connector from a position wherein the cross rail components are positioned end to end to form the cross rail and a second position wherein the cross rail components are in a side by side position. Again, the finished bed frame can be provided in a compact package and assembled without the use of tools or any extraneous hardware.

In a third embodiment, both of the side rail components are hingedly attached to the center side rail leg so that both can be pivoted from an end to end orientation of a bed frame to a side by side orientation for compactness. The cross rail are the same as in the second embodiment.

In a fourth embodiment, the side rails are similar to that of the second embodiment and the cross rails are again comprised of two cross rail components that are hinged together at a center cross rail leg. In this embodiment, the small wedges located at the free ends of the cross rail components are inserted into slots formed in the side rail legs. The wedges have a flexible tab with a bottom edge that projects outwardly such that the wedge can be inserted into the slot in a side rail leg and the bottom end of the wedge projects outwardly from the open bottom of the slot to lock the cross rail components to the side rail legs. The bottom edges need to thereof be displaced inwardly to allow the wedge to be removed from this slot. Again however, the entire bed frame can be reduced to a compact package and assembled to the full bed frame by a person having minimal skills and without the need for tools or any extraneous hardware.

In a fifth embodiment, there is a locking system that can be used to easily lock the side rail or cross rail components into their orientation where the side rail or cross rail components are oriented end to end to form a completed side rail or cross rail and yet be readily unlocked to allow pivoting or rotation of the side rail or cross components to an orientation where they are side to side and thus in a compact configuration.

As used herein, the term "wedge" is used to describe the male member and the term "receiver" used to describe the female member of a connection; however, the terms do not necessarily imply that there must be a taper to either the wedge or the receiver. As will be seen, in at least one exemplary embodiment, the wedge and receiver may both be cylindrical or slightly tapered in configuration. It should also be noted that the term "receiver" used with this invention generally also serves as a leg for the bed frame.

These and other features and advantages of the present invention will become more readily apparent during the following detailed description taken in conjunction with the drawings herein.

BRIEF DESCRIPTION OF THE DRAWINGS

First Embodiment

Second Embodiment

Figure 7:
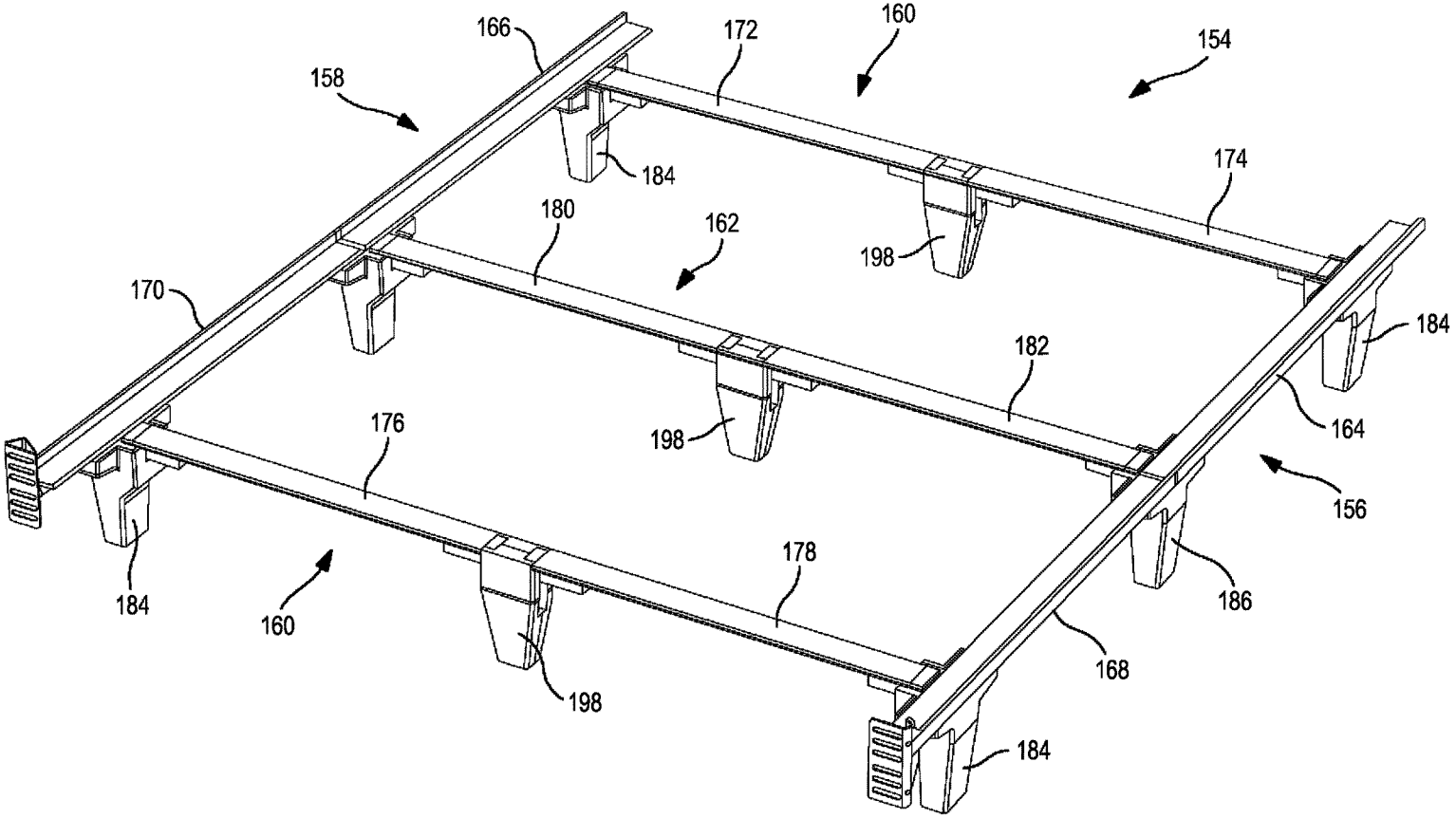
Figure 8:
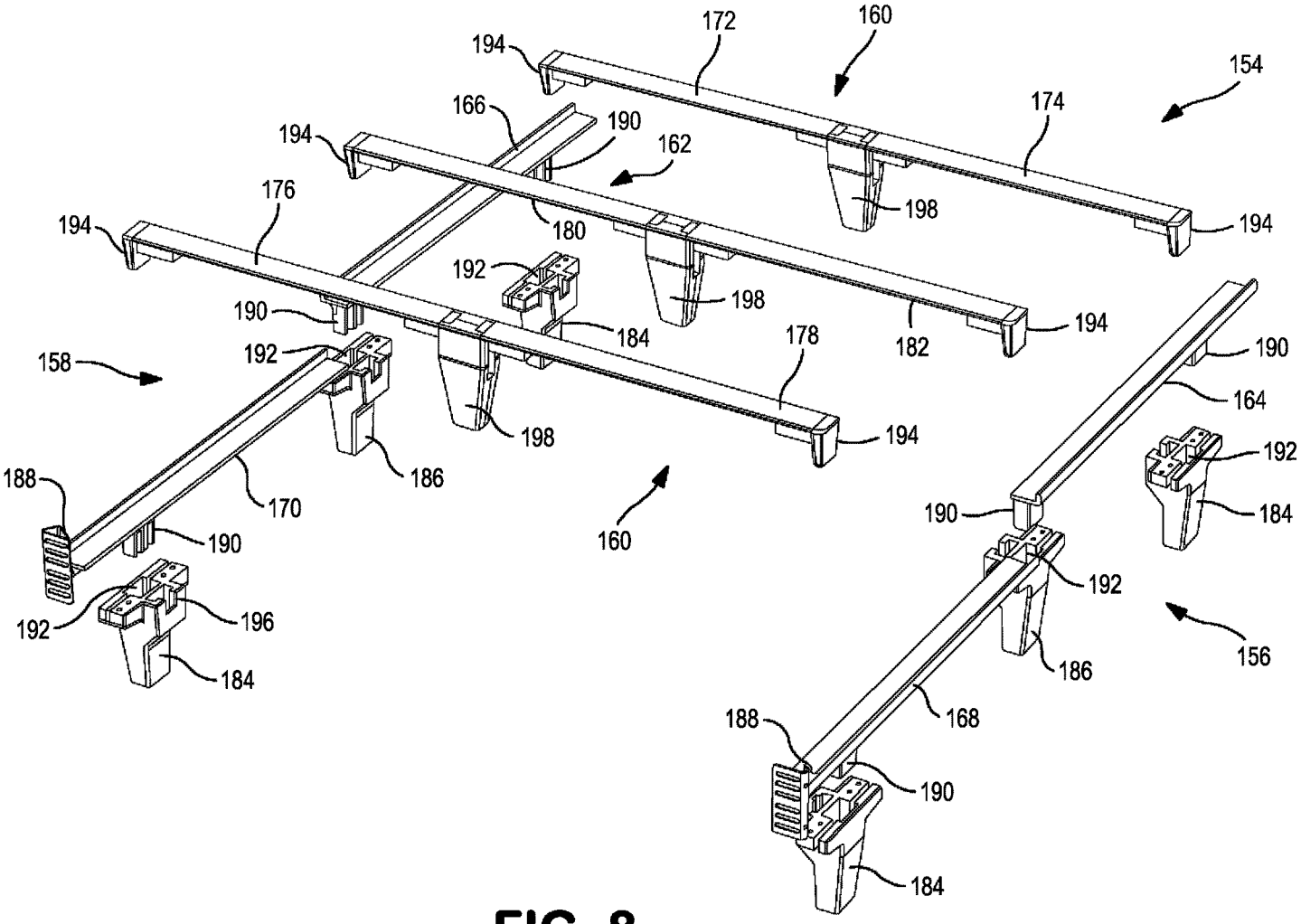
Figure 9:
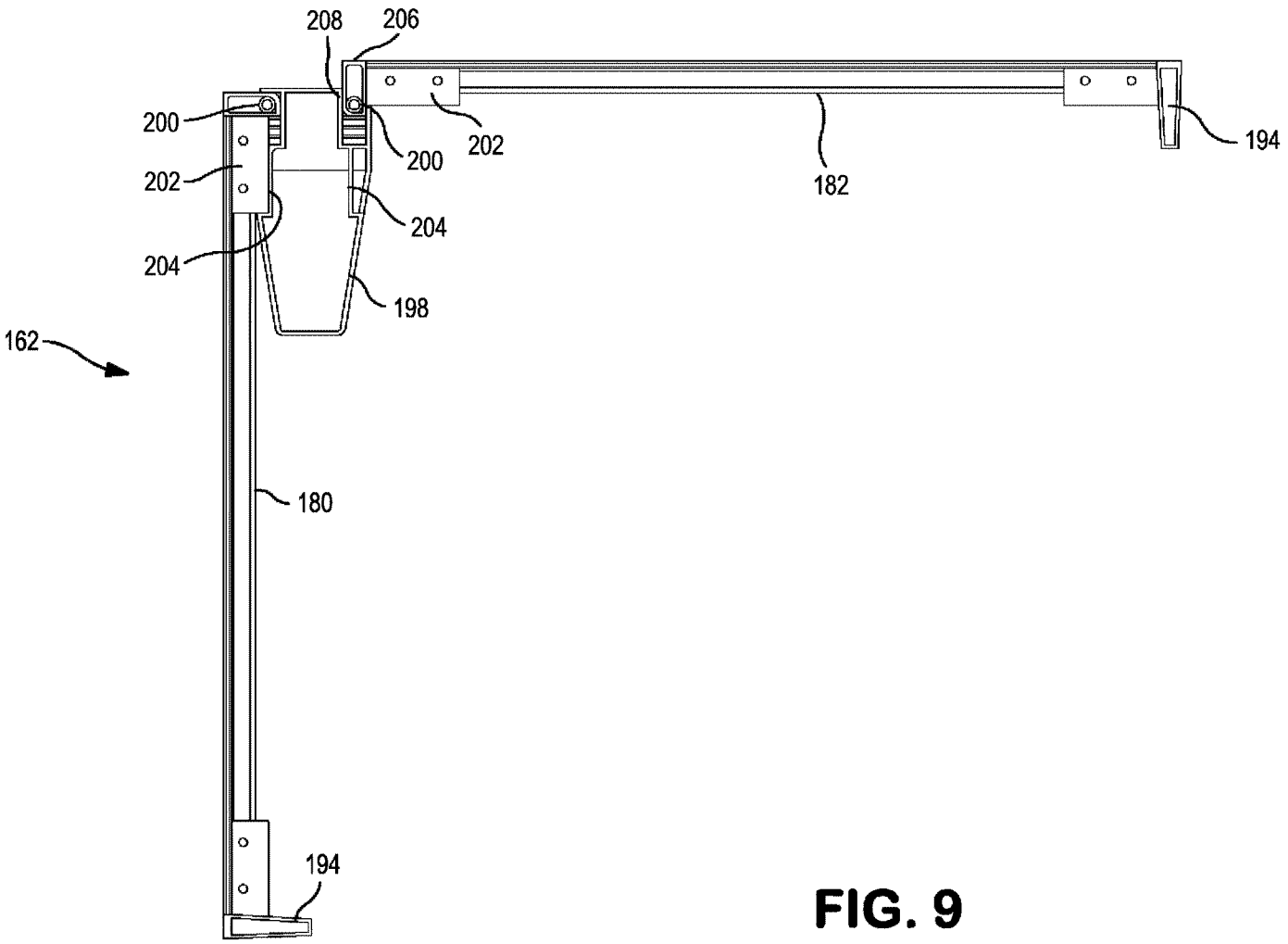
Figure 10:
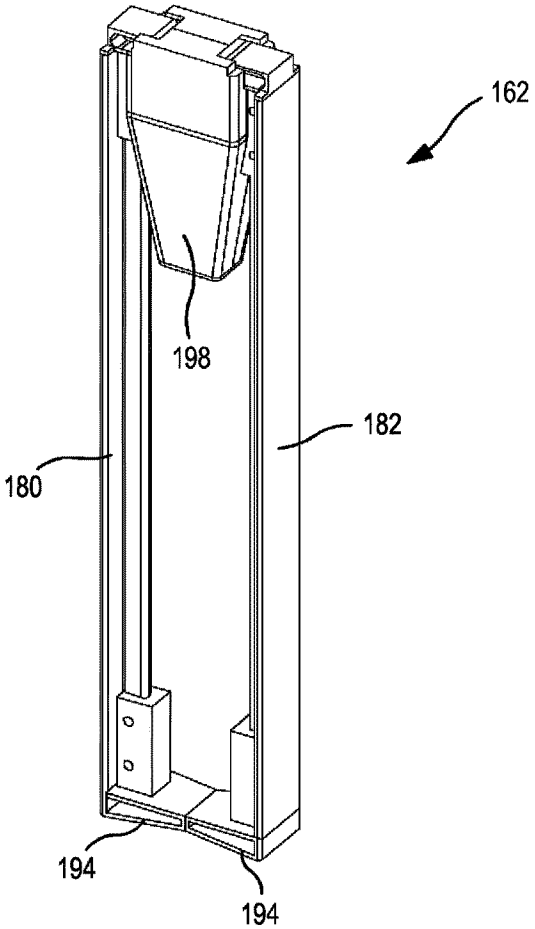
Figure 11:
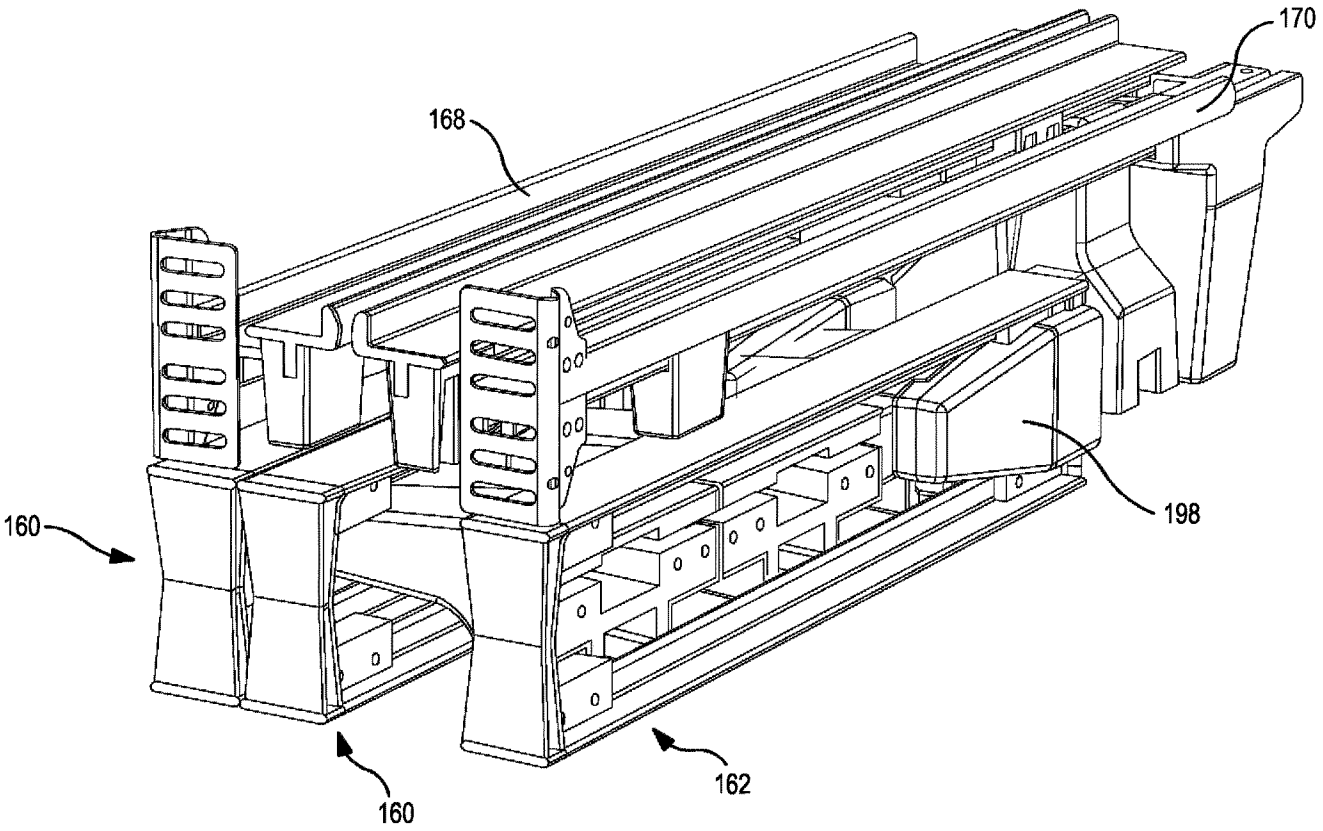
Figure 12:
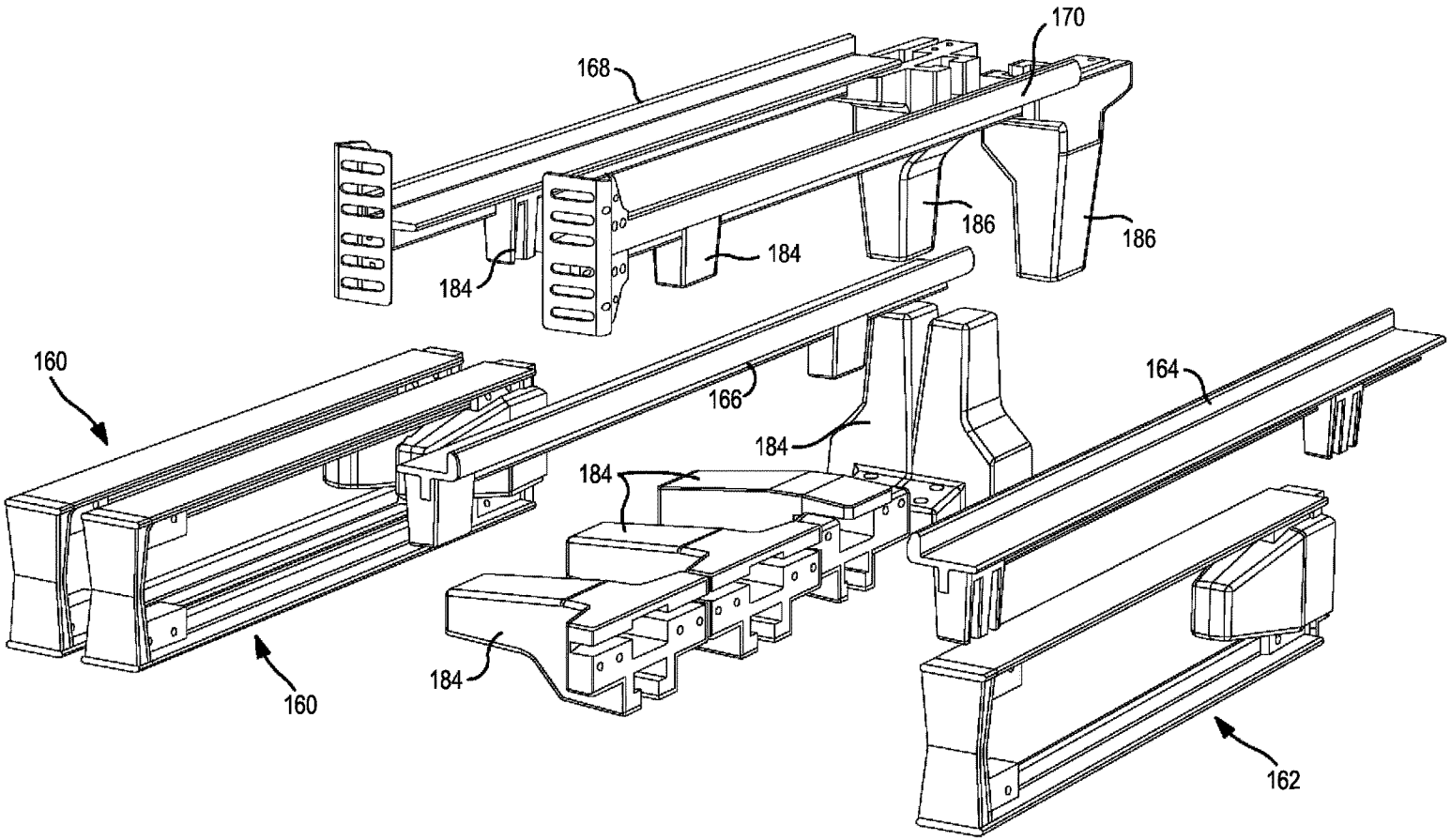

FIG. 7 is a perspective view of an assembled bed frame constructed in accordance with a second embodiment of the present invention;

FIG. 8 is an exploded view illustrating the individual components of the bed frame of FIG. 7;

FIG. 9 is a side view showing the components of a cross rail of the FIG. 7 embodiment with one cross rail component pivoted;

FIG. 10 is a perspective view of a cross rail of the FIG. 7 embodiment illustrating the pivoting of both cross rail components to a parallel configuration;

FIG. 11 is a perspective view showing the components of the bed frame of FIG. 7 configured for a compact, easily handled package;

FIG. 12 is an exploded view illustrating the arrangement of the bed frame components of FIG. 11 adapted to be fit into a package;

Third Embodiment

Figure 13:
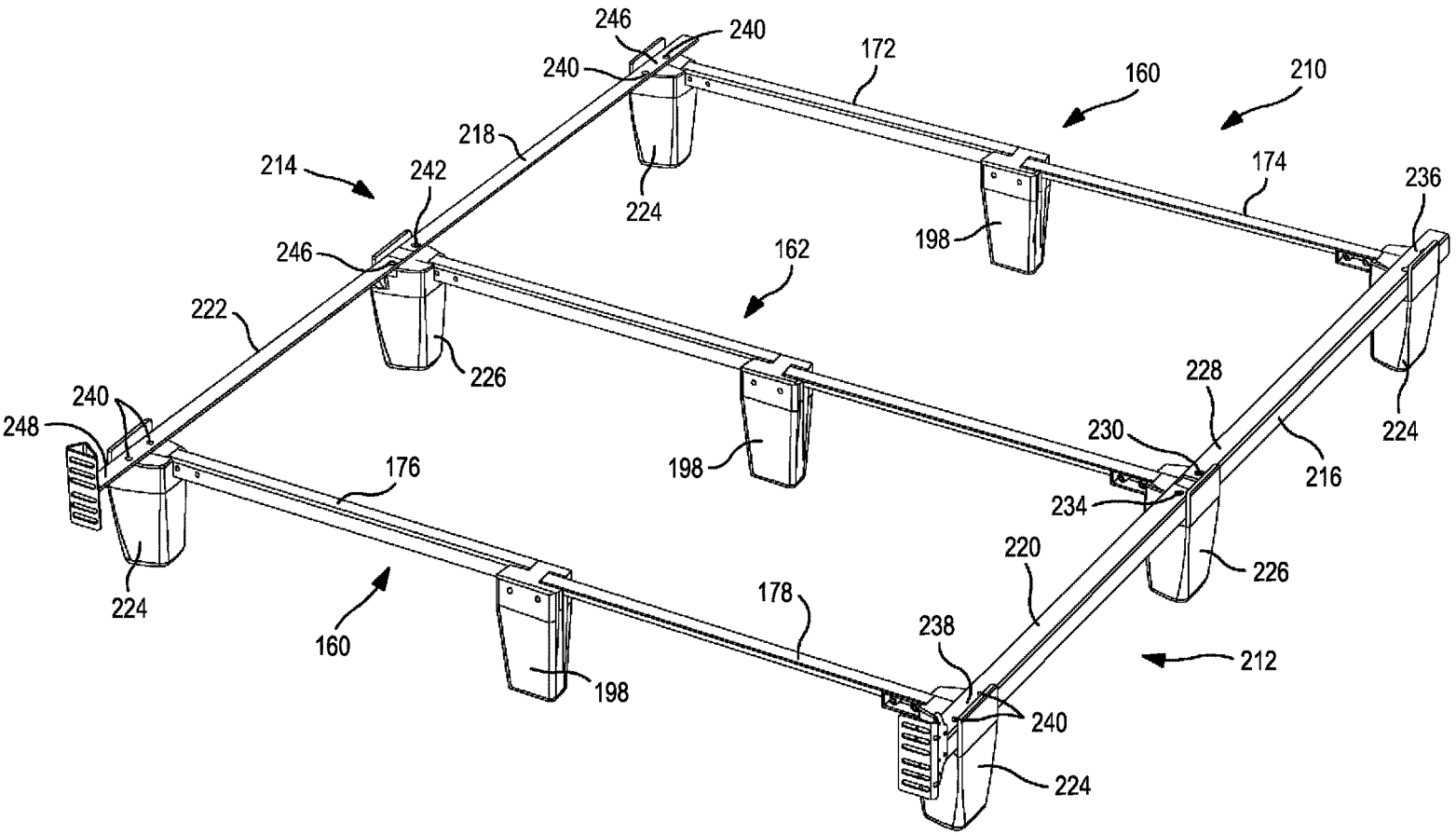
Figure 14:
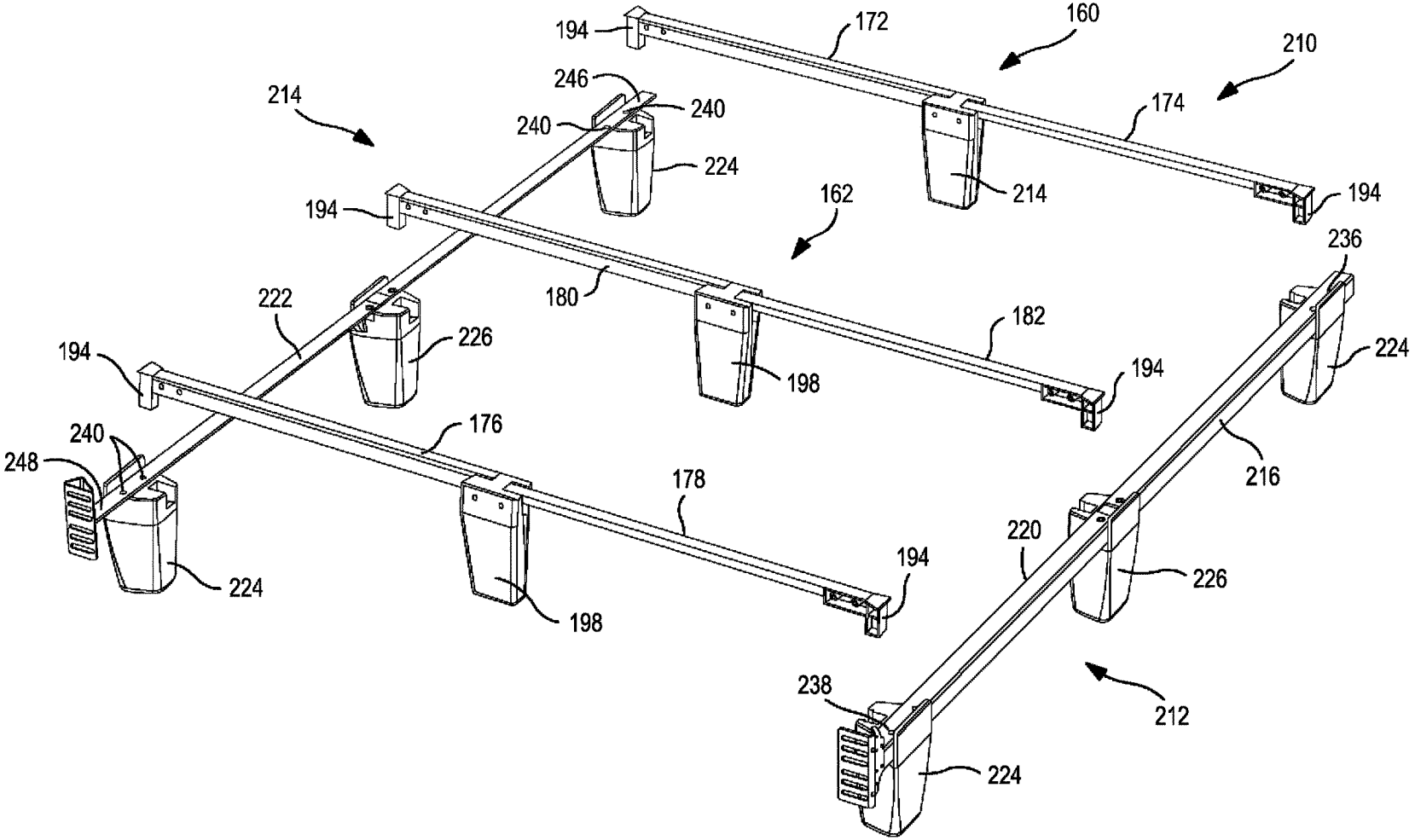
Figure 15:
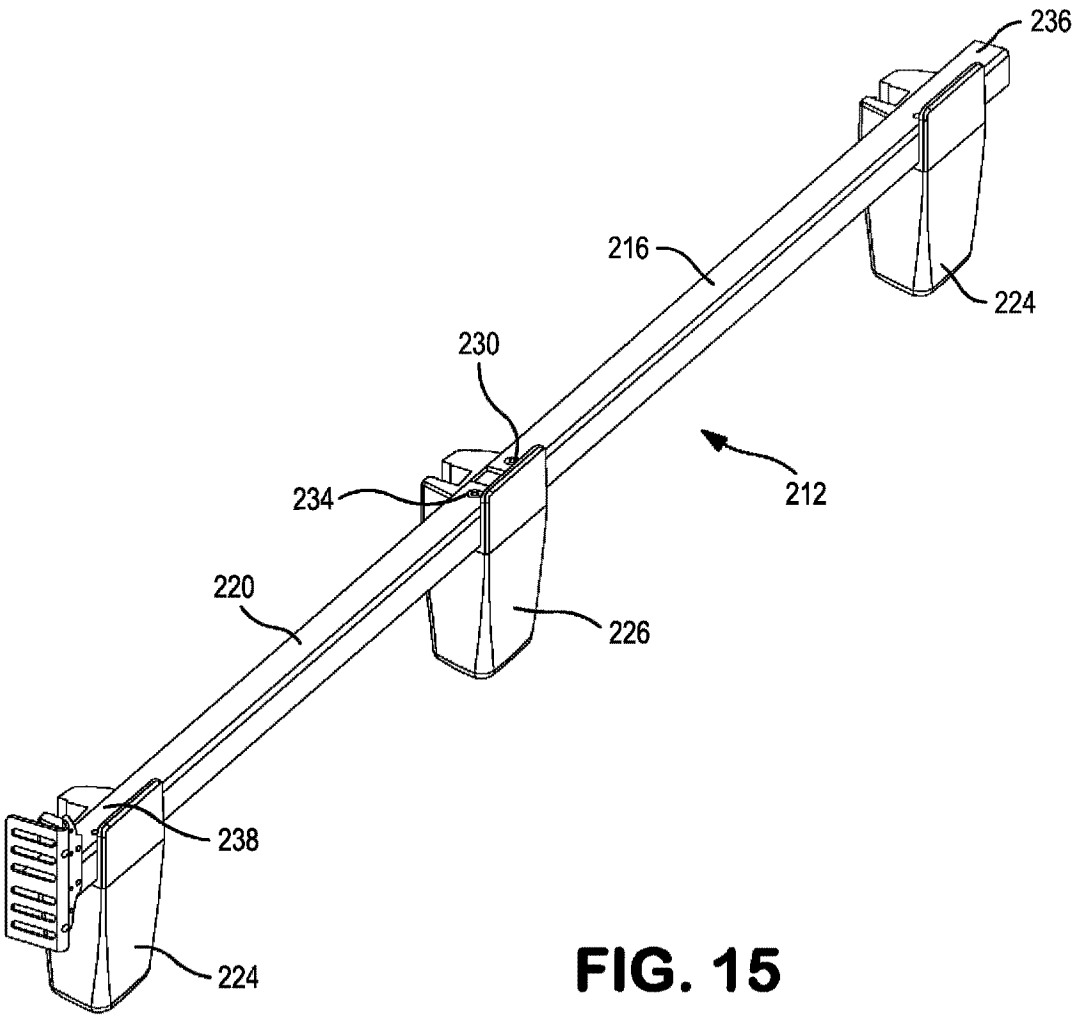
Figure 16:
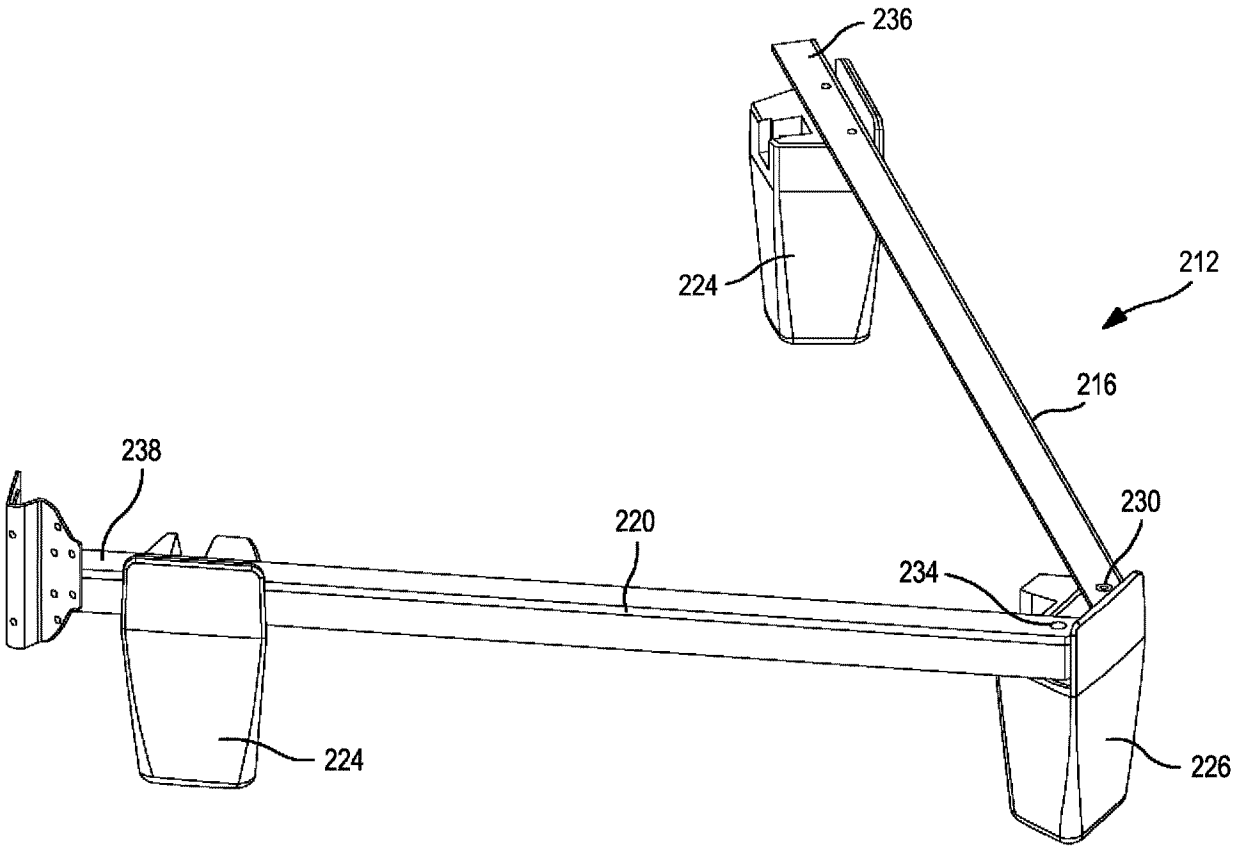
Figure 17:
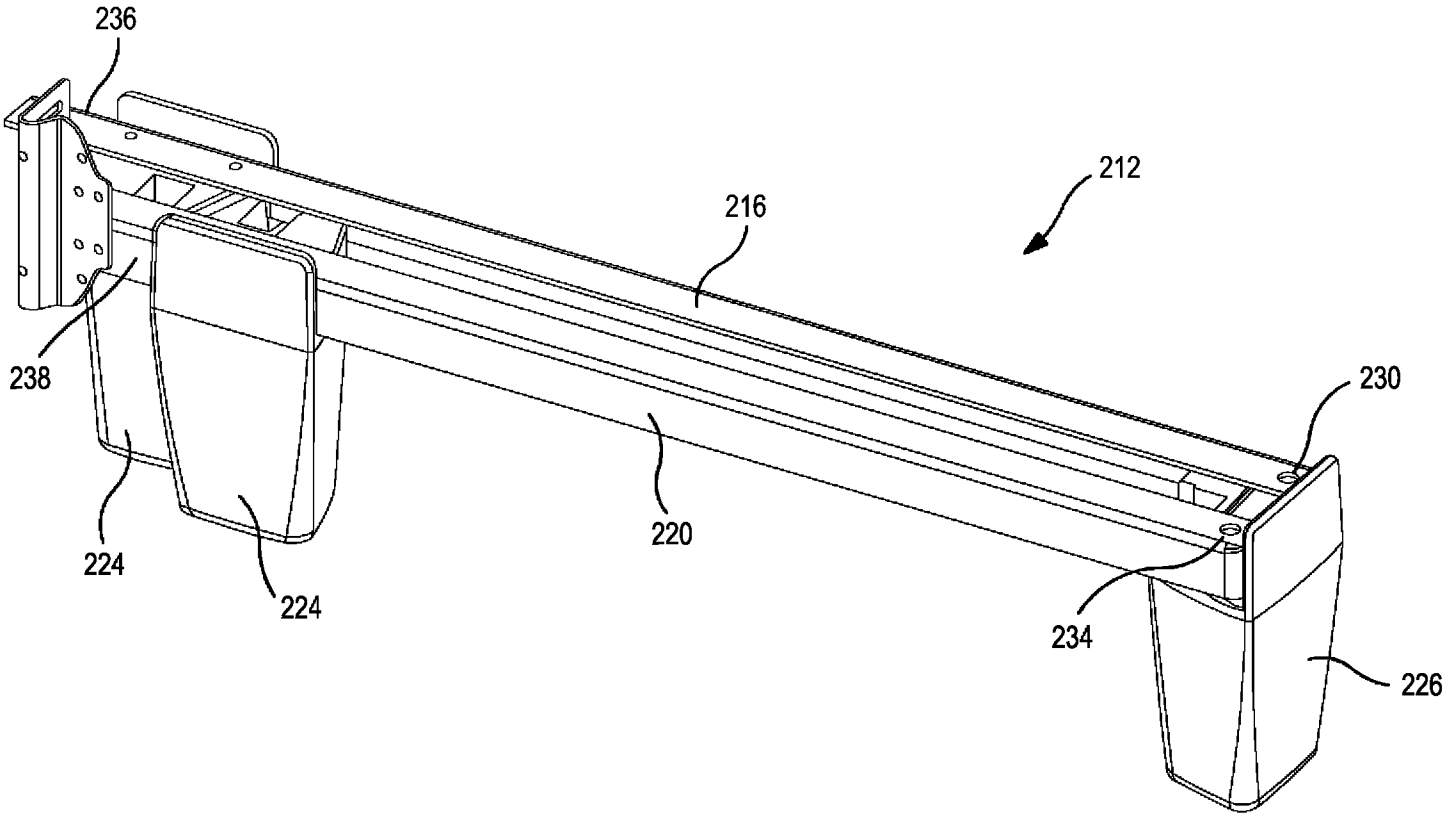
Figure 18:
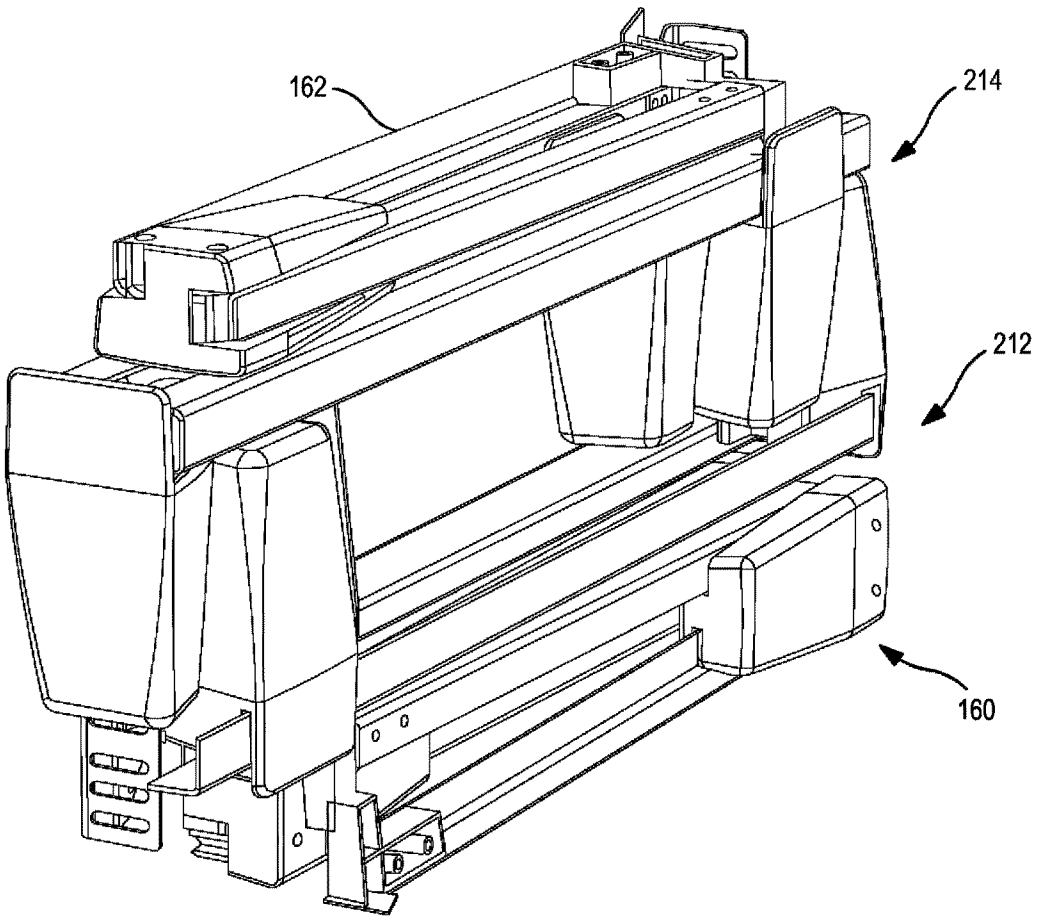
Figure 19:
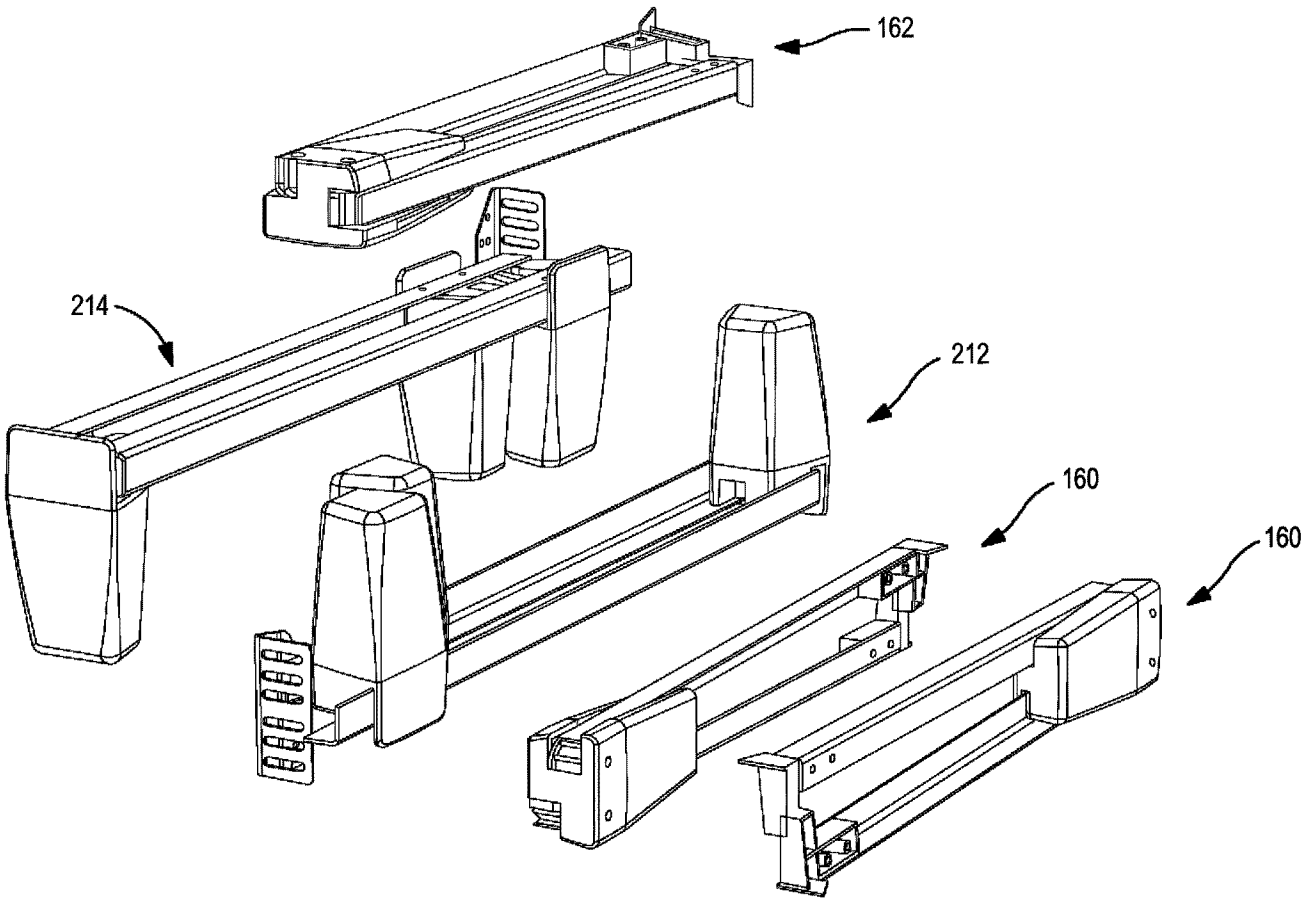

FIG. 13 is a perspective view of an assembled bed frame constructed in accordance with a third embodiment of the present invention;

FIG. 14 is an exploded view illustrating the individual components of the bed frame of FIG. 13;

FIG. 15 is a perspective view illustrating a side rail of the FIG. 13 embodiment;

FIG. 16 is a perspective view of a side rail of the FIG. 13 embodiment illustrating the pivoting of the side rail components;

FIG. 17 is a perspective view of a side rail with both side rail components pivoted to a parallel orientation;

FIG. 18 is a perspective view showing the components of the bed frame of FIG. 13 configured for a compact, easily handled package;

FIG. 19 is an exploded view illustrating the arrangement of the bed frame components of FIG. 18 adapted to be fit into a package;

Fourth Embodiment

Figure 20:
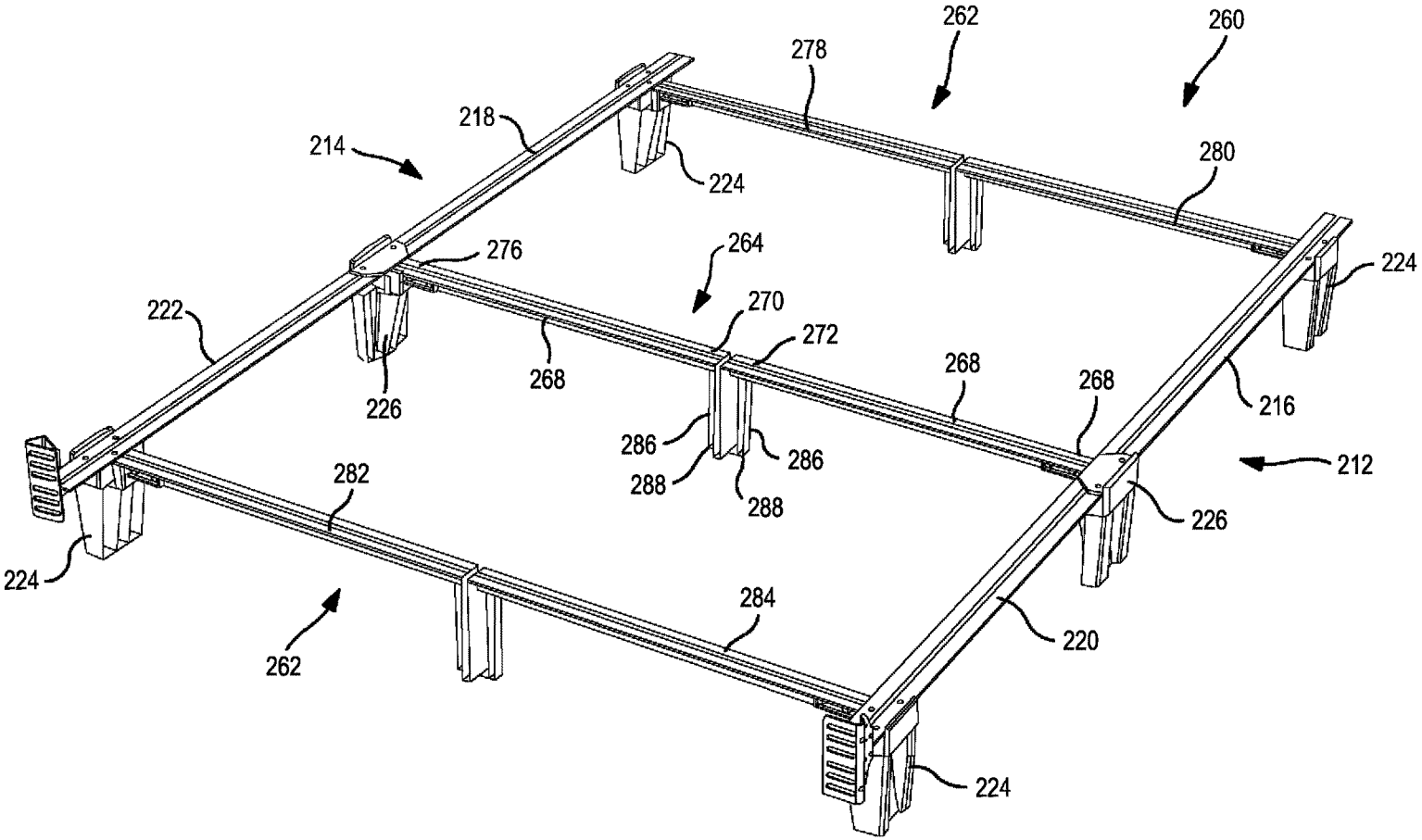
Figure 21:
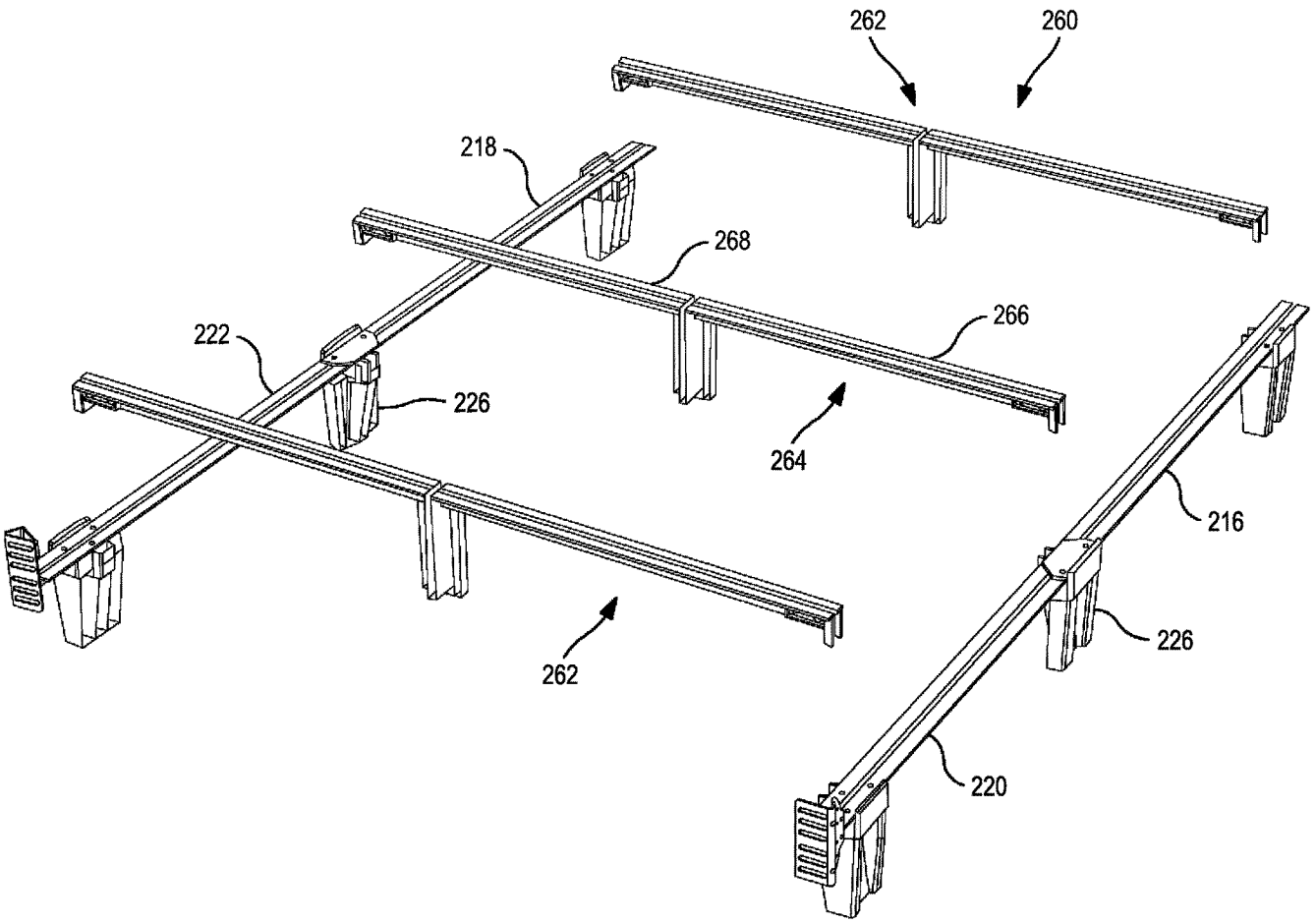
Figure 22:
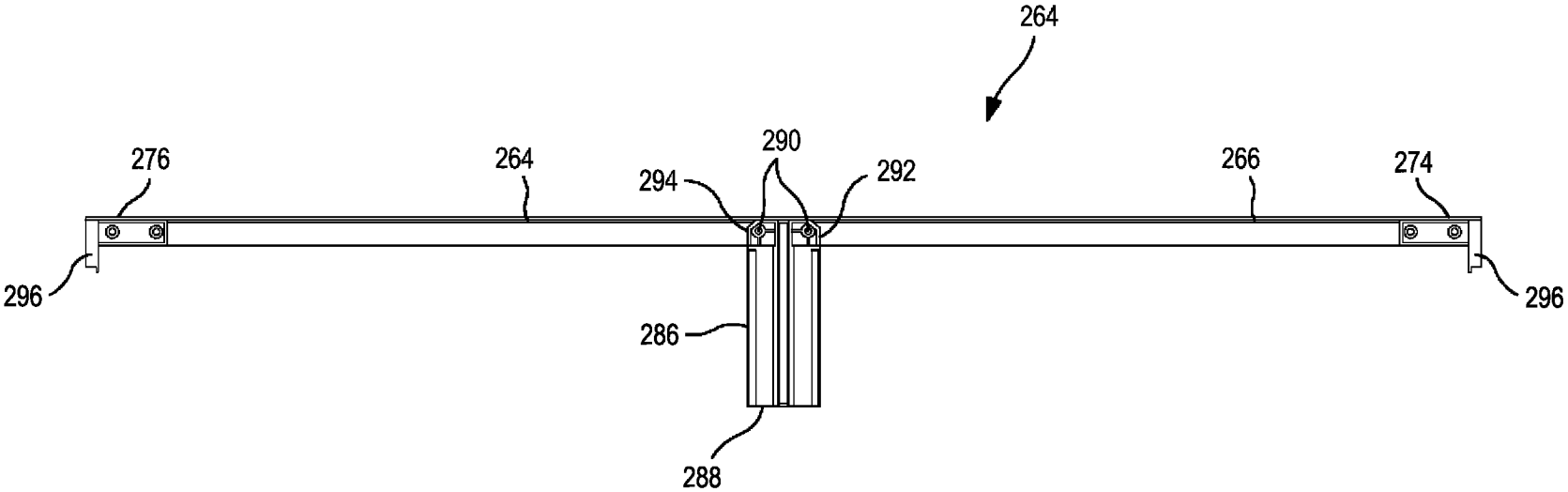
Figure 23:
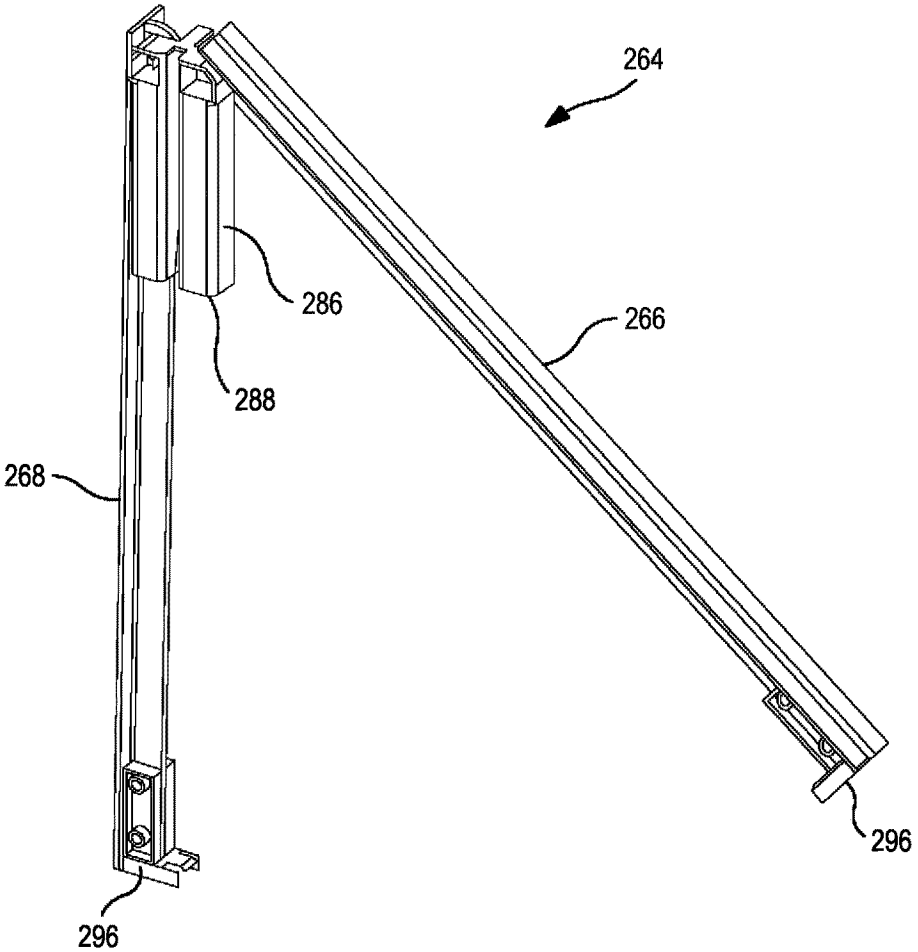
Figure 24:
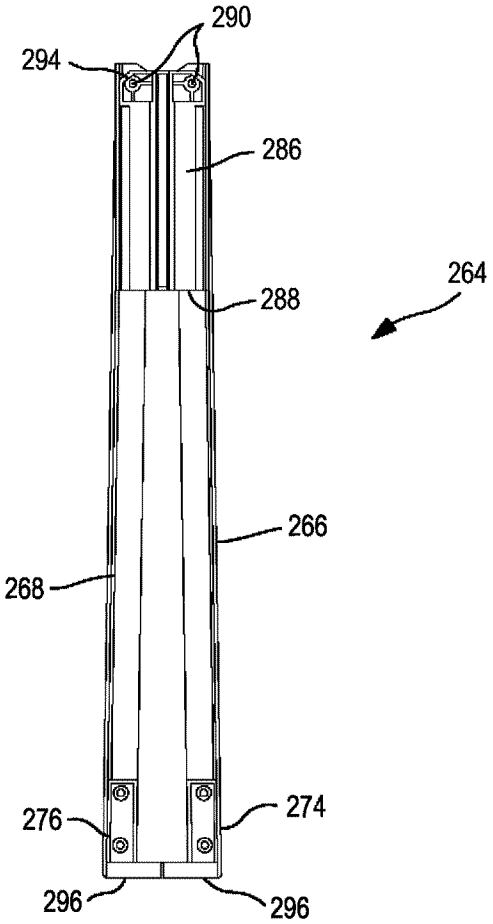
Figure 25:
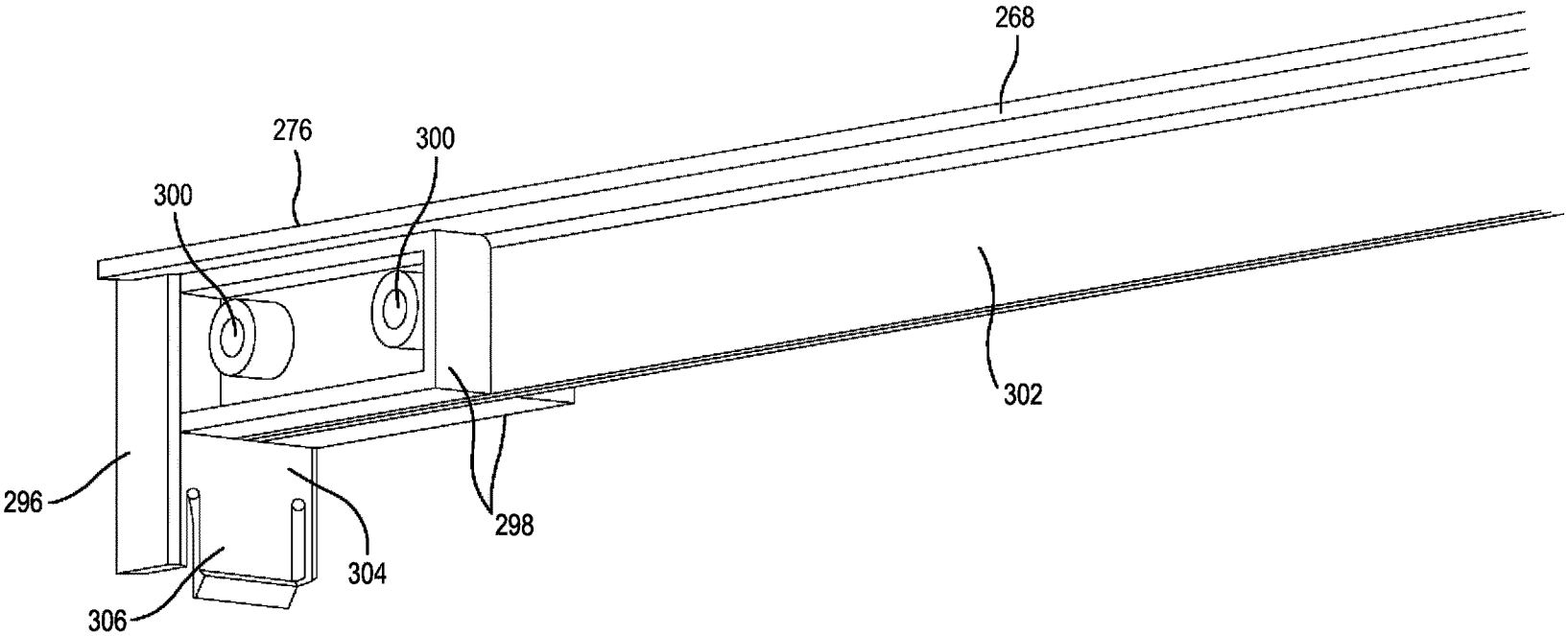
Figure 26:
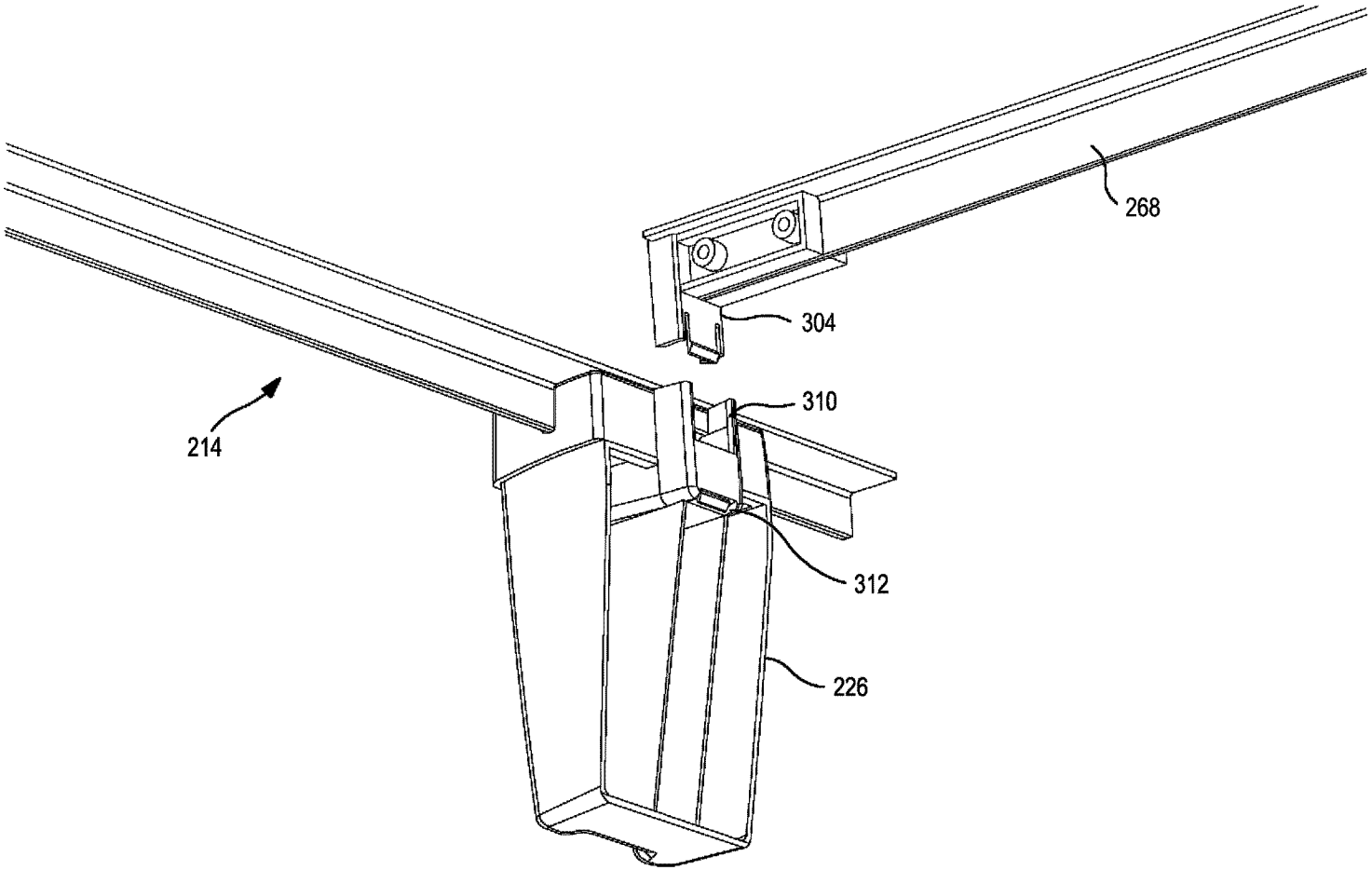
Figure 27:
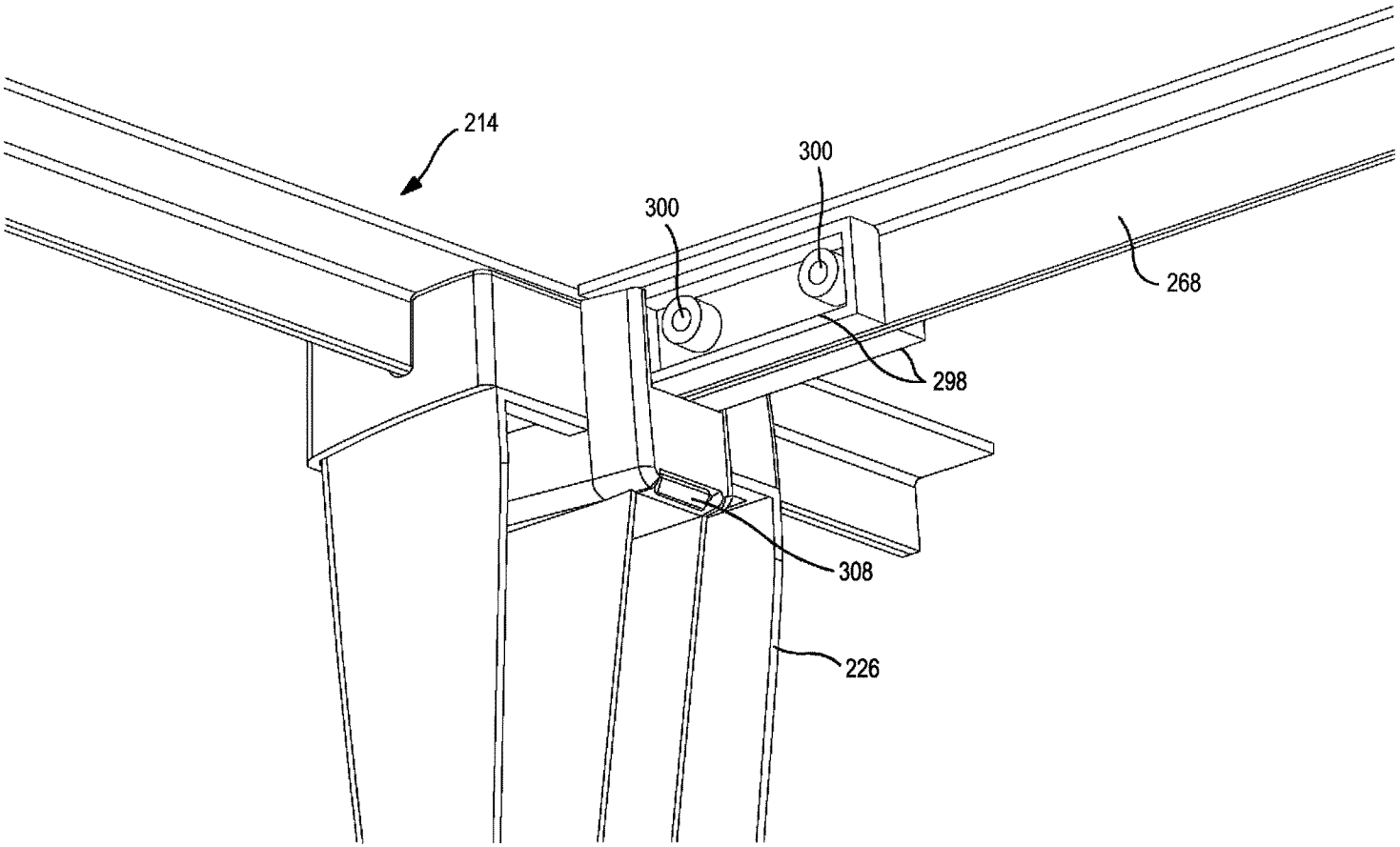
Figure 28:
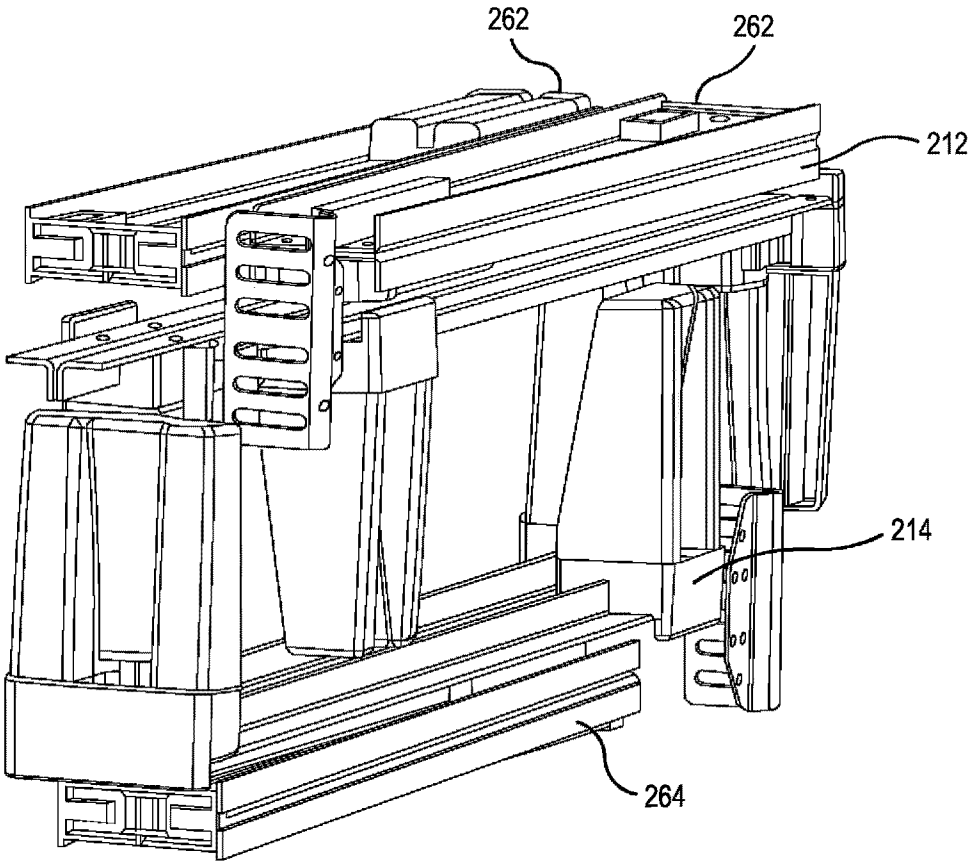
Figure 29:
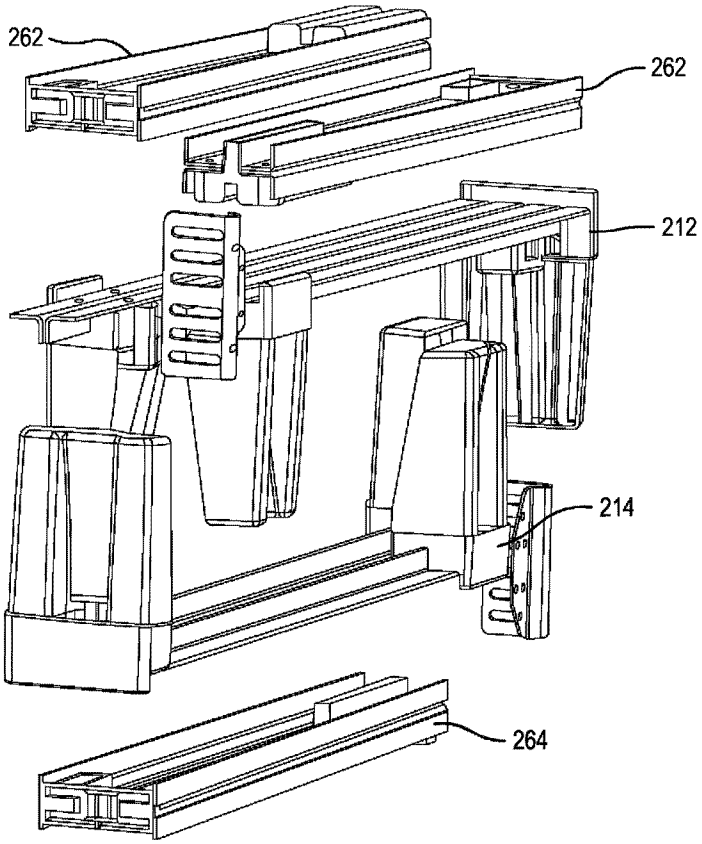

FIG. 20 is a perspective view of an assembled bed frame constructed in accordance with a fourth embodiment of the present invention;

FIG. 21 is an exploded view illustrating the individual components of the bed frame of FIG. 29;

FIG. 22 is a side view of a cross rail of the FIG. 20 embodiment;

FIG. 23 is a perspective view of a cross rail of the FIG. 20 embodiment illustrating the pivoting of a cross rail component;

FIG. 24 is a side view of a side rail with both side rail components pivoted to a parallel orientation;

FIG. 25 is a perspective detail view of an end of a cross rail of the FIG. 20 embodiment illustrating the connector thereon;

FIG. 26 is an exploded detail view illustrating the connection between a cross rail and a side rail of the FIG. 20 embodiment;

FIG. 27 is a perspective detail view illustrating the completed connection between a cross rail and a side rail of the FIG. 20 embodiment;

FIG. 28 is a perspective view showing the components of the bed frame of FIG. 20 configured for a compact, easily handled package;

FIG. 29 is an exploded view illustrating the arrangement of the bed frame components of FIG. 28 adapted to be fit into a package;

Fifth Embodiment

Figure 30:
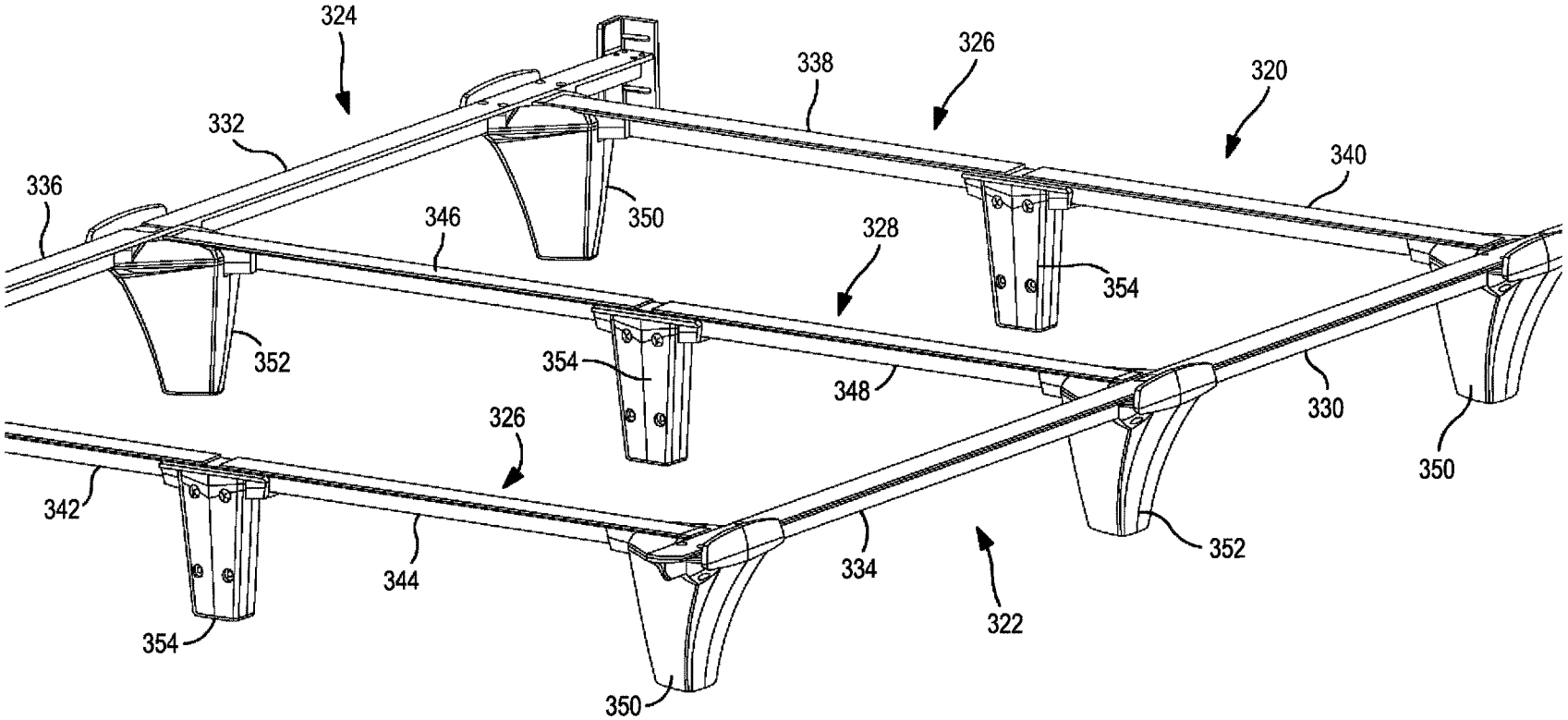
Figure 31:
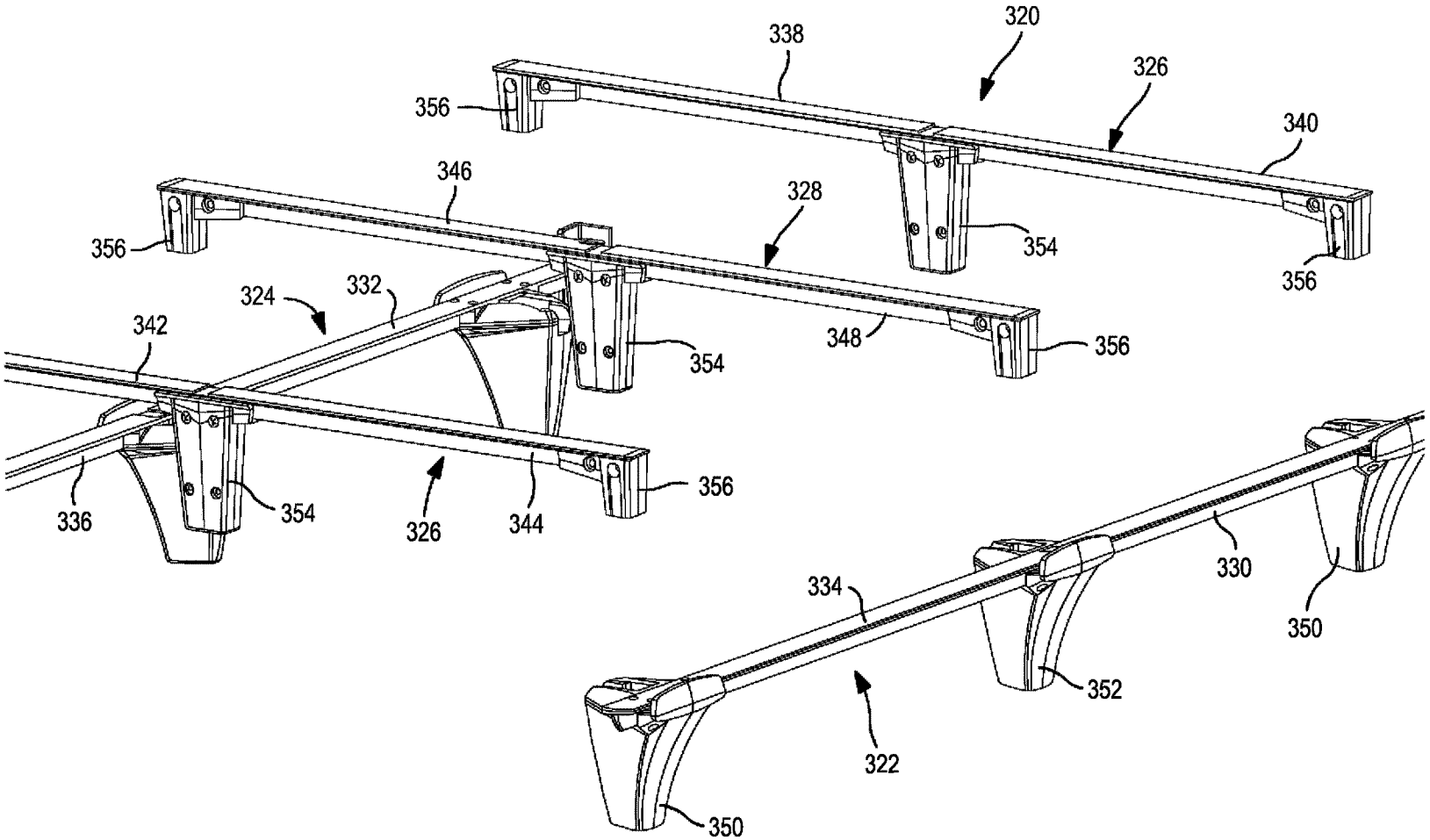
Figure 32:
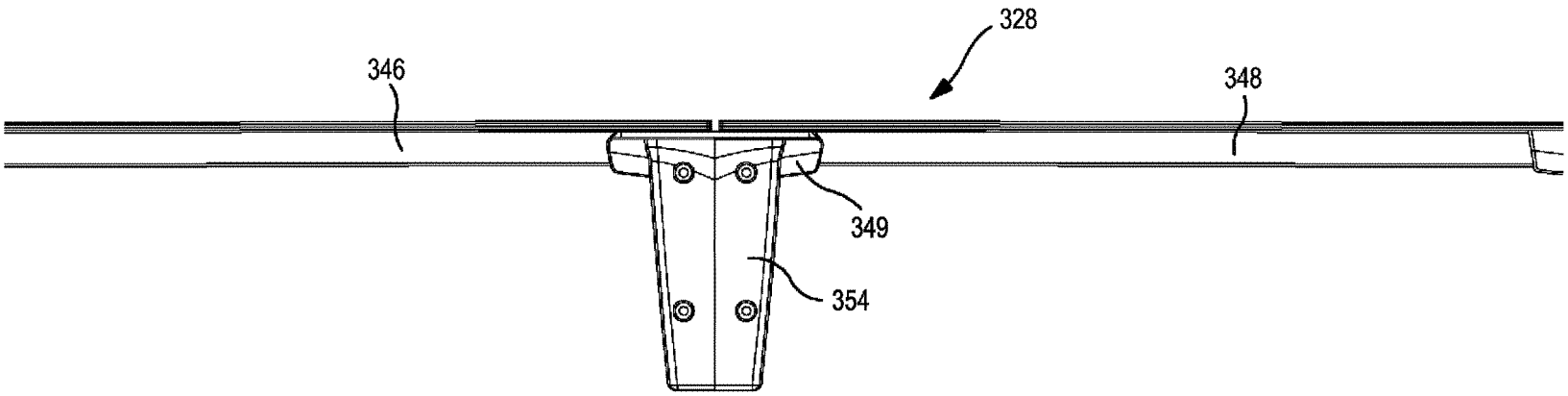
Figure 33:
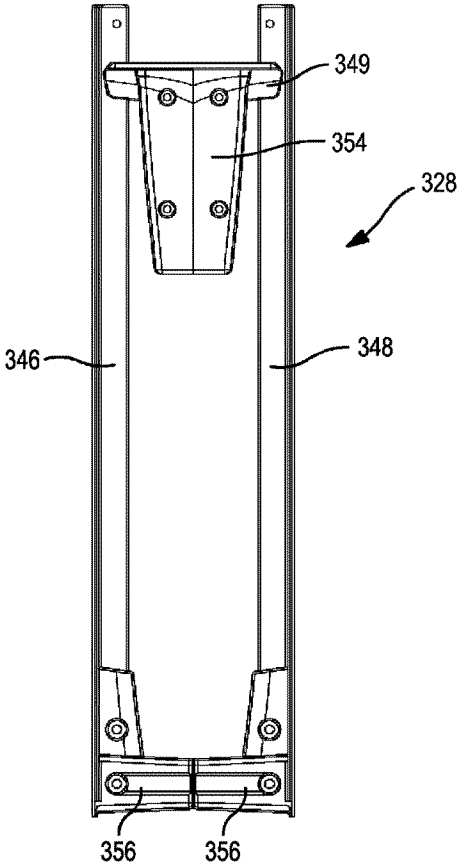
Figure 34:
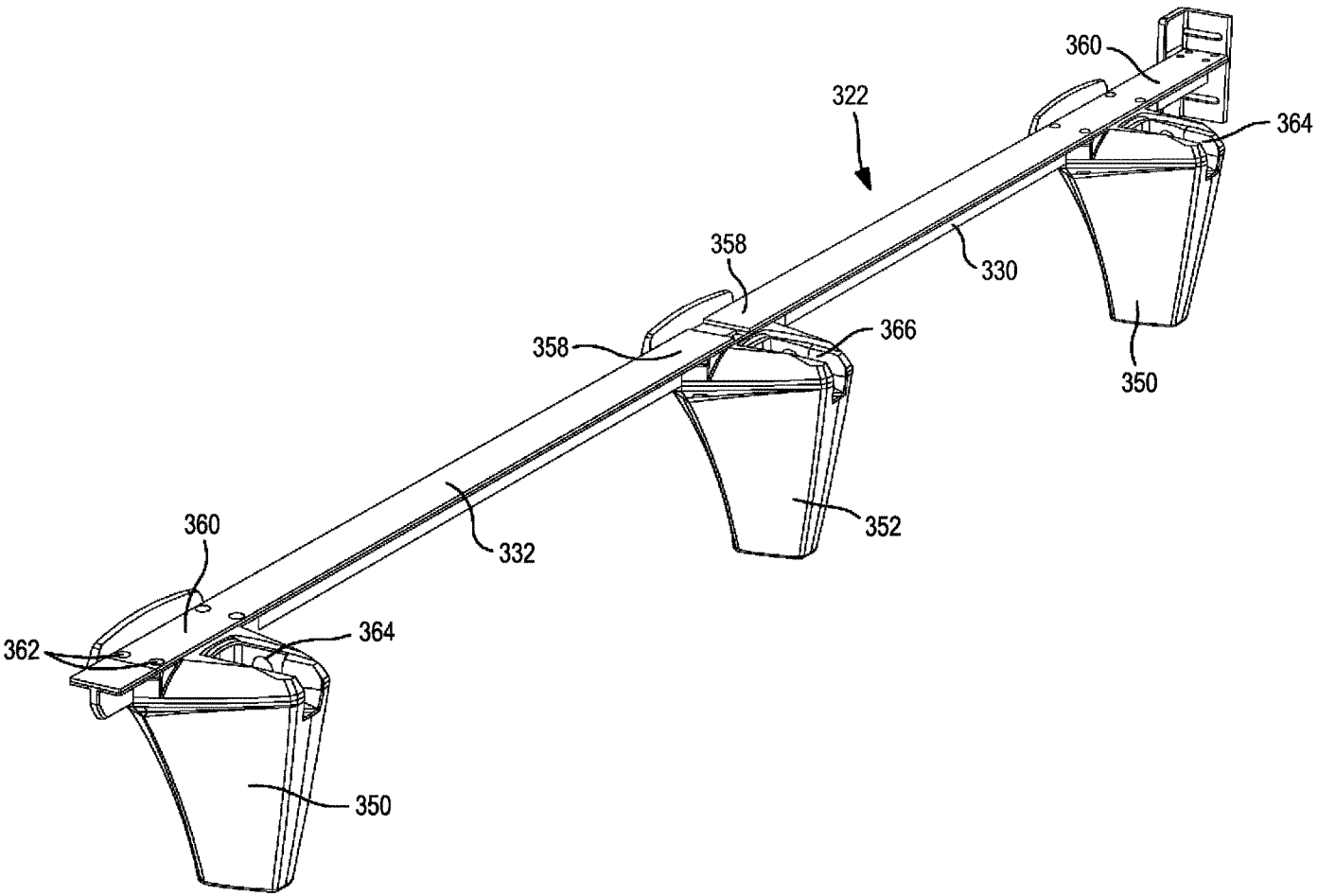
Figure 35:
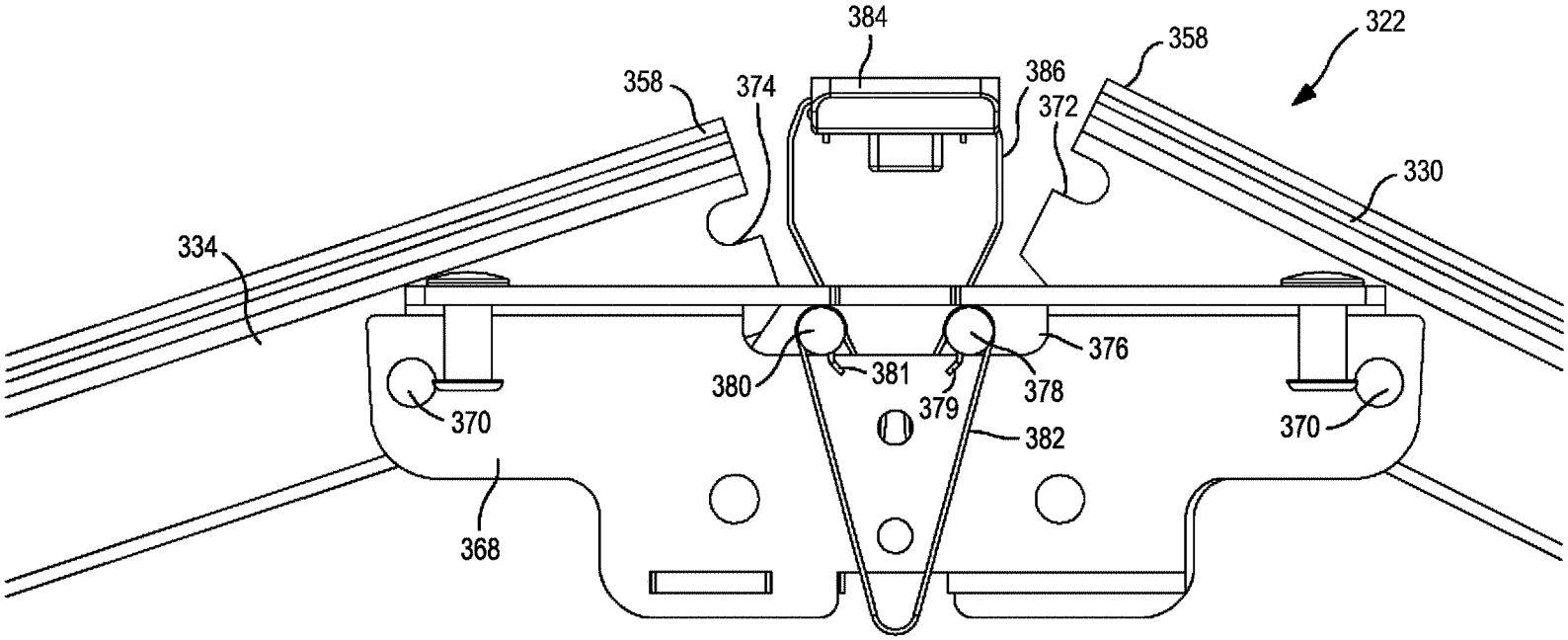
Figure 36:
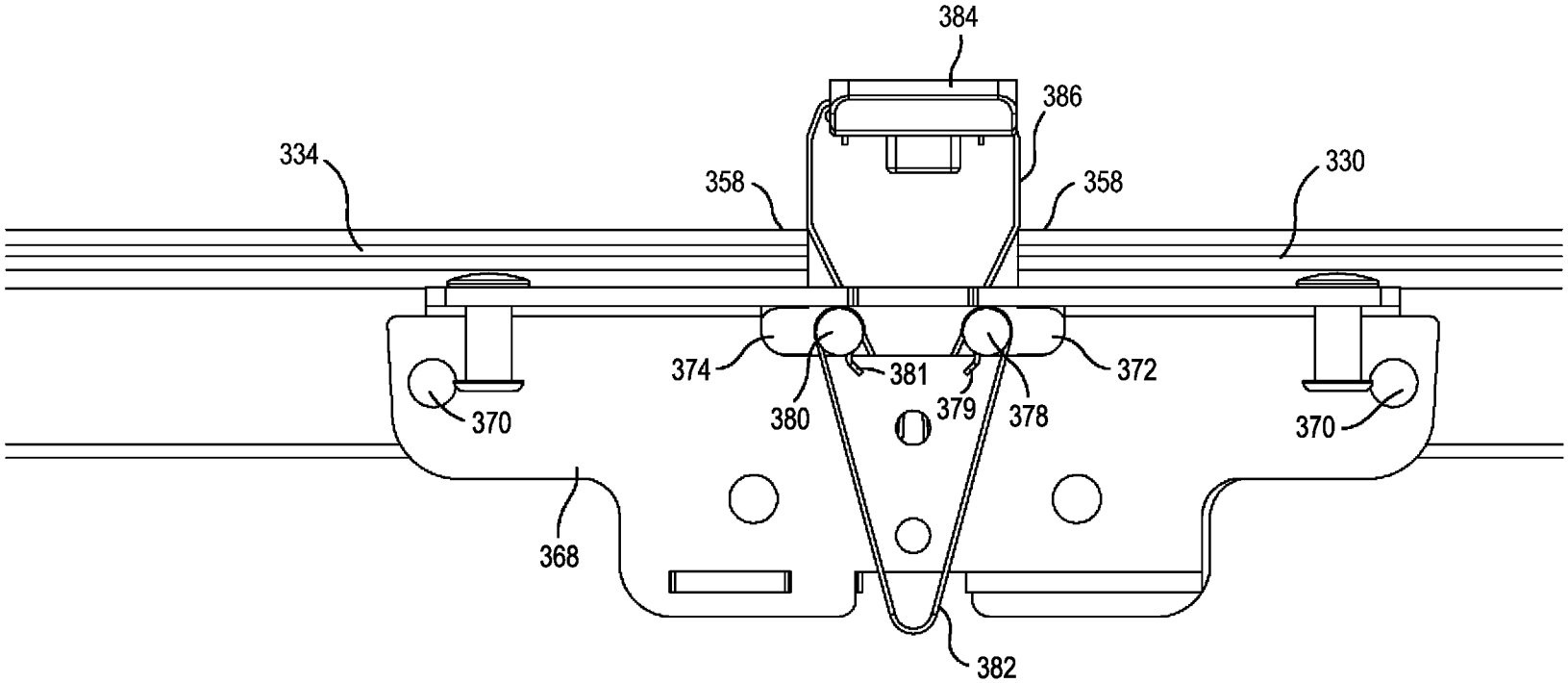
Figure 37:
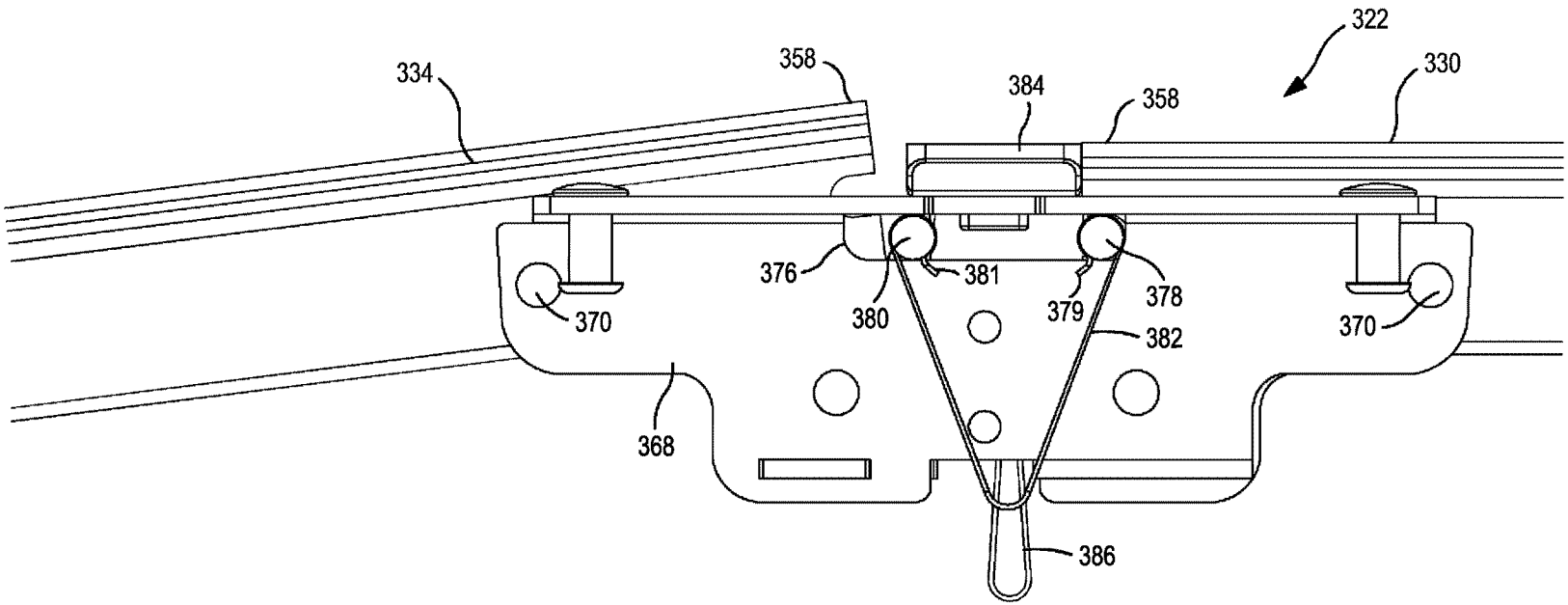
Figure 38:
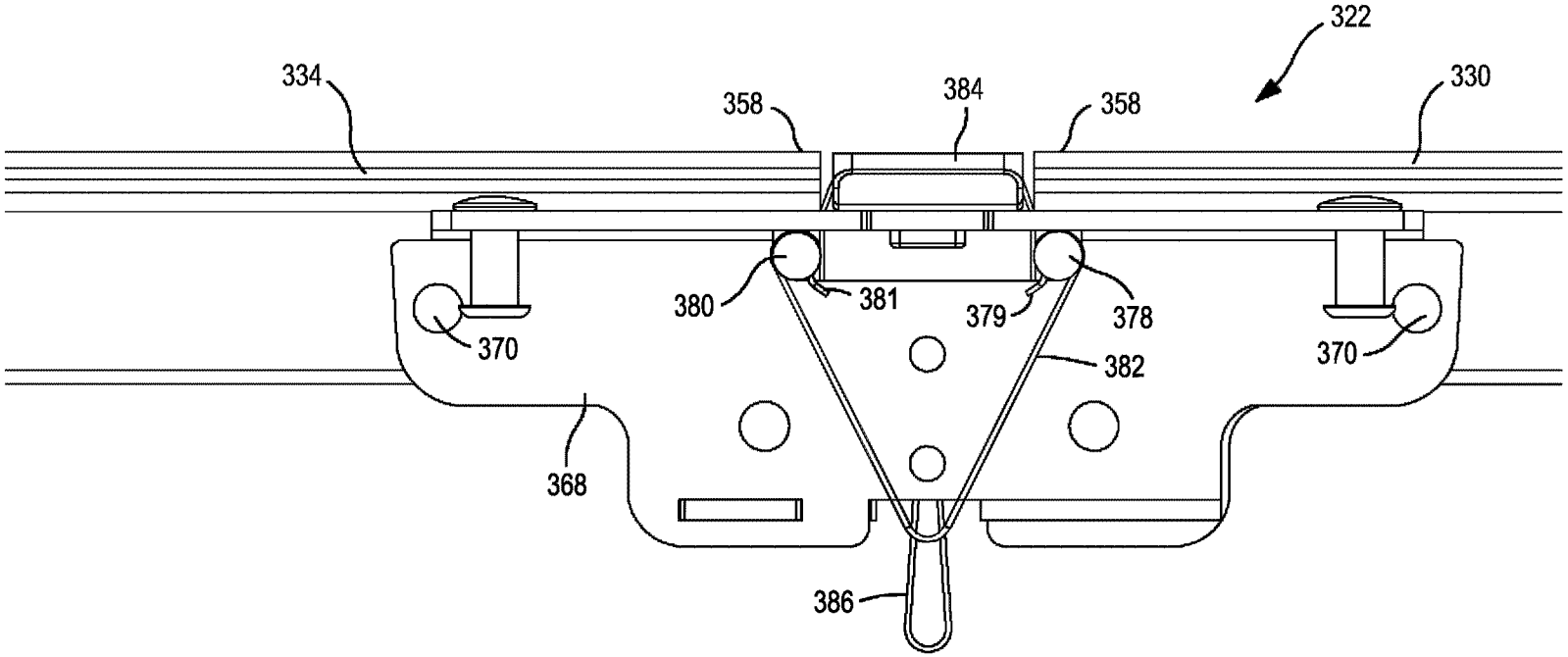
Figure 39:
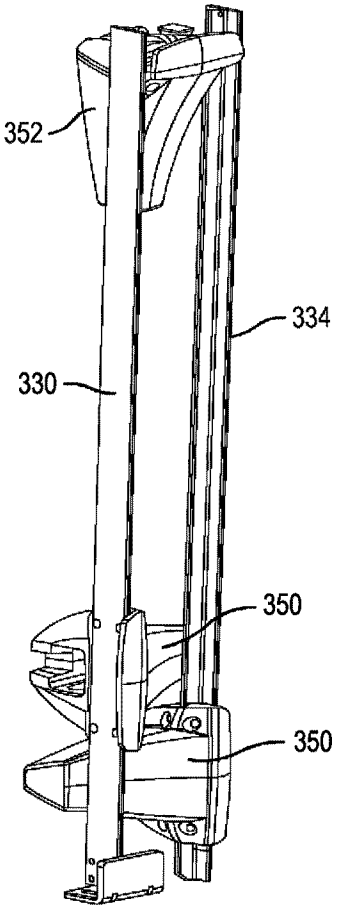

FIG. 30 is a perspective view of an assembled bed frame constructed with the use of a locking system used with the side rails;

FIG. 31 is an exploded view illustrating the individual components of the bed frame of FIG. 30;

FIG. 32 is a side view of a cross rail of the FIG. 30 embodiment;

FIG. 33 is a side view of a cross rail of FIG. 32 in a folded up orientation;

FIG. 34 is a perspective view of a side rail of the FIG. 30 embodiment;

FIG. 35 is an enlarged side view illustrating the connection between side rail components of the FIG. 30 embodiment;

FIG. 36 is a further enlarged side view of the connection between side rail components of the FIG. 30 embodiment;

FIG. 37 is a further enlarged side view of the connection between side rail components of the FIG. 30 embodiment;

FIG. 38 is a still further enlarged side view of the connection between side rail components of the FIG. 30 embodiment; and FIG. 39 is a perspective view of a side rail of the FIG. 30 embodiment in its folded orientation; and.

Figure 40:
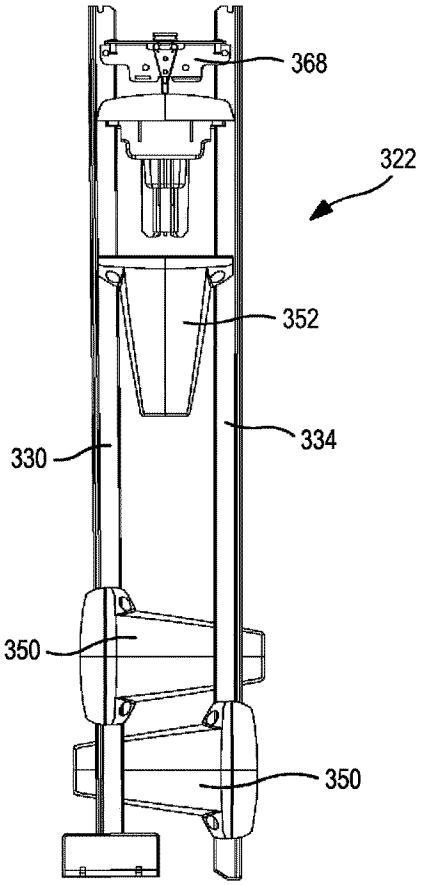

FIG. 40 is a side view of the FIG. 30 embodiment in its folded orientation.

DETAILED DESCRIPTION OF THE INVENTION

Figure 1:
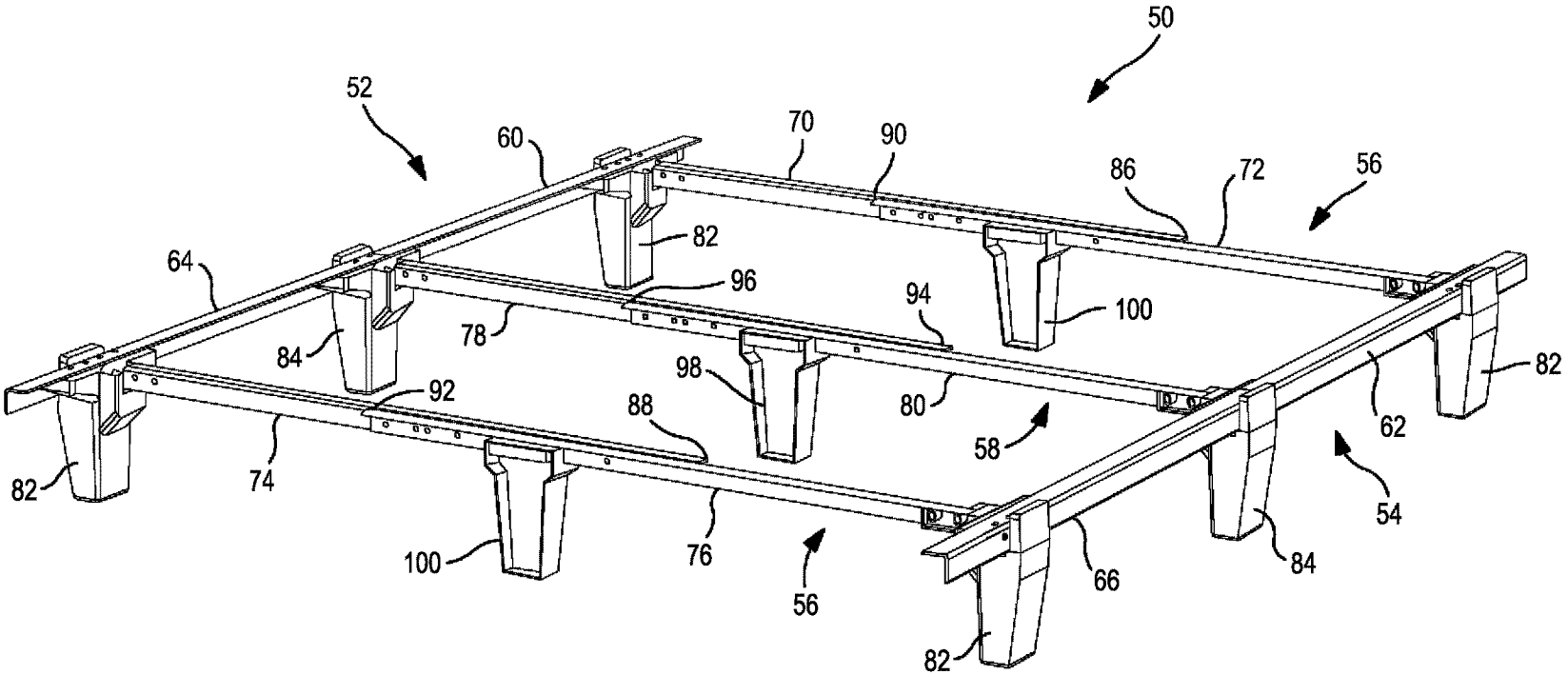
FIG. 1 is a perspective view of an assembled bed frame constructed in accordance with a first embodiment of the present invention.

Turning first to FIG. 1 there is shown, a perspective view of the first embodiment of a bed frame 50 constructed in accordance with the present invention. As can be seen, the bed frame 50 is comprised of two side rails 52, 54 that are attached to three cross rails, that is, end cross rails 56 and center cross rail 58. The side rails 52, 54 themselves are comprised of first and second side rail components 60, 62 and 64, 66, respectively. The same is true of end cross rails 56 and center cross rail 58 that are, respectively comprised of end cross rail components 70, 72, 74 and 76 and center cross rail components 78, 80.

In addition, there are side rail end legs 82 and side rail center legs 84. As will become clear, the first side rail components 60, 62 are factory affixed to the side rail center legs 84. The second side rail components 64, 66 are affixed between the side rail center legs 84 and a pair of the side rail end legs 82 in a manner that does not require any tools and will be later explained.

Each of the end cross rail components 70 and 74 have inner ends 86, 88 that overlap with inner ends 90, 92 of end cross rail components 72 and 76 forming a junction. In a similar manner the inner ends 94, 96 of center cross rail components 78, 80 overlap with each other forming a junction.

At the junctions of the overlapping inner ends 94, 96 of the center cross rail components 78, 80, there is a center cross rail leg 98 that supports that connection. Similarly, at the junctions of the overlapping inner ends 86, 90 and 88, 92 of end cross rail components 70, 72, 74 and 76 there are end cross rail legs 100.

Figure 2:
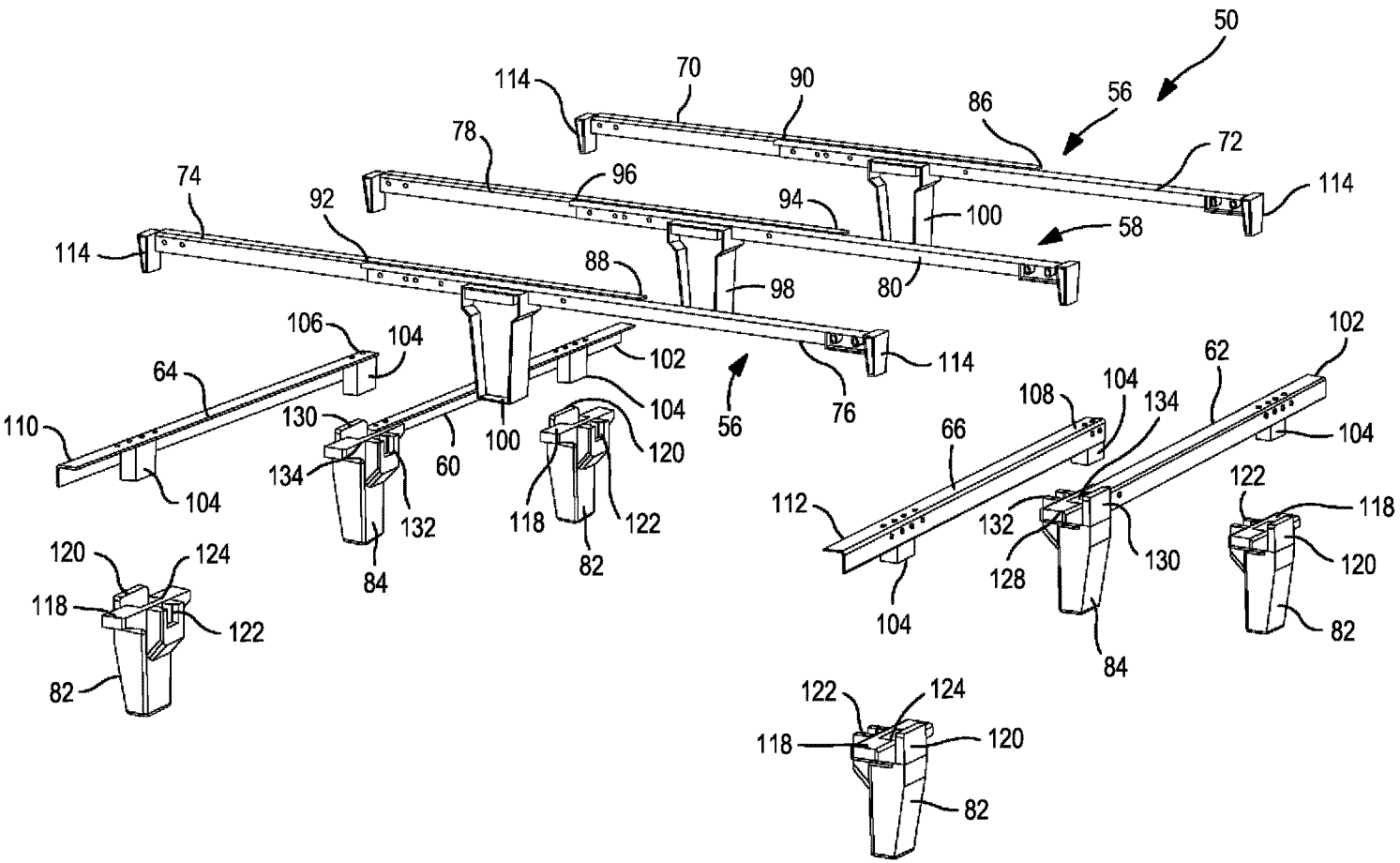
FIG. 2 is an exploded view illustrating the individual components of the bed frame of FIG. 1.

Turning then to FIG. 2, taken along with FIG. 1, there can be seen an exploded view illustrating the assembly of the bed frame 50 of this embodiment. As such, there can be seen that the first side rail components 60, 62 have one end affixed to the side rail center legs 84 and have free ends 102. The first and second side rail components 60, 62 are preferably L-shaped angle irons with a flat horizontal flange and a vertical flange extending downwardly. Just inwardly of the free ends 102, there is a wedge 104 that is a downwardly tapering truncated pyramid shape and which can be better seen and described in published Patent Application 2010/0242171 A1, published Sep. 30, 2010 and entitled Three Dimensional Connection System For Bed Frame. A wedge 104 is also provided at the inner ends 106, 108 of the second side rail components 64, 66 as well as near the outer ends 110, 112 of the second side components 64, 66.

A small wedge 114 is secured to the outer ends of the end cross rails 56 and the center cross rail 58. The small wedges 114 are tapered inward in the downward direction and are secured to the outer ends of the end cross rails 56 and center cross rail 58 by means of rivets. The small wedge 114 can constructed of plastic or metal.

As also can be seen, the side rail end legs 82 are located at or near the ends of the side rails 52, 54. The side rail end legs 82 are, of course adapted to contact a planar surface, such as a floor, and support the bed frame 50 as well as the bedding that is later added to the bed frame 50. As such, the side rail end legs 82 have an upper surface 118 that supports the first and second side rail components 60, 62, 64, 66 and also includes an upstanding flange 120 extending above the upper, flat surface of the first and second side rail components 60, 62, 64, 66 in order to retain the box spring mounted atop of the bed frame 50 in the proper position.

Each of the end side rail legs 82 also has an inner slot 122 formed therein and which will be later explained. In brief, however, the dimensions of the inner slot 110 are such that a small wedge 114 can be interfitted therein. Each end side rail leg 82 also has a receiver 124 that is basically an inwardly tapered opening that is dimensioned to accept a wedge 104 when interfitted therein.

The side rail center legs 84 are located approximately mid way between the outer ends of the side rails 52, 54. The side rail center legs 84 also have, similar to the side rail end legs 82, a upper surface 128 with an upstanding flange 130 along with a inner slot 132 and a receiver 134.

It can now be understood how the bed frame 50 of this embodiment is assembled without the need for any tools, again referring to FIGS. 1 and 2. The side rails 52 and 54 are easily assembled by attaching the first and second side rail components 60, 64, taking side rail 52 as an example. The wedge 104 located at the bottom of the inner end 106 of the second side rail component 64 is inserted into the receiver 134 in the side rail center leg 84. This move effectively creates a full length side rail 54. The same action is taken with respect to the opposite side rail 52 so that both of the side rails 52, 54 are readily assembled together.

Again, using side rail 52 as an example, the side rail end legs 82 are readily assembled to the outer end 110 and the inner end 106 of the second side rail component 64 by simply inserting the wedges 104 into the receivers 124 in the legs 82. Again, the same action is taken with respect to the side rail 54.

At the point, the end cross rails 56 and center cross rail 58 (their assembly will be later explained) can be affixed to the side rails 52, 54 by simply dropping the small wedges 114 into the inner slots 122 and 132, thereby completing the assembly of the bed frame 50 without the need for any tools and thus the entire assembly can be easily performed by a homeowner with little or no skills, tool-free and totally eliminates the need to hunt for tools or look for missing fasteners.

Figure 3:
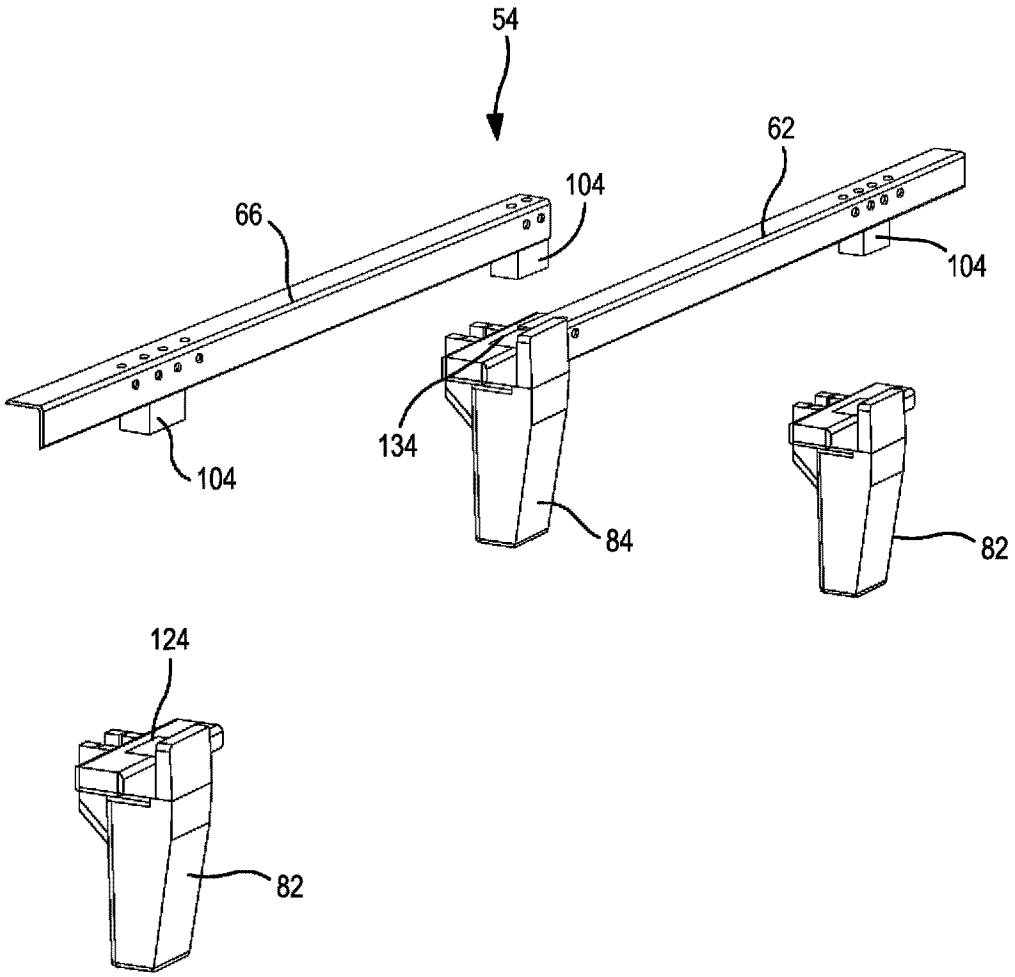
FIG. 3 is an exploded view illustrating a side rail of the FIG. 1 embodiment.

Turning briefly to FIG. 3, there is shown an exploded view illustrating the assembly of a side rail, in this case side rail 54, however, as explained, both side rails 52, 54 are assembled in the same manner. As can be seen, the wedges 104 of the second side rail component 66 and the wedge 104 of the first side rail component 62 are positioned to be moved downwardly into the receivers 124 and 134, respectively, of the side rail end leg 82 and the side rail middle leg 84 to complete the attaching of the side rail end legs 82 and the side rail middle leg 84 of the side rail 54.

Figure 4:
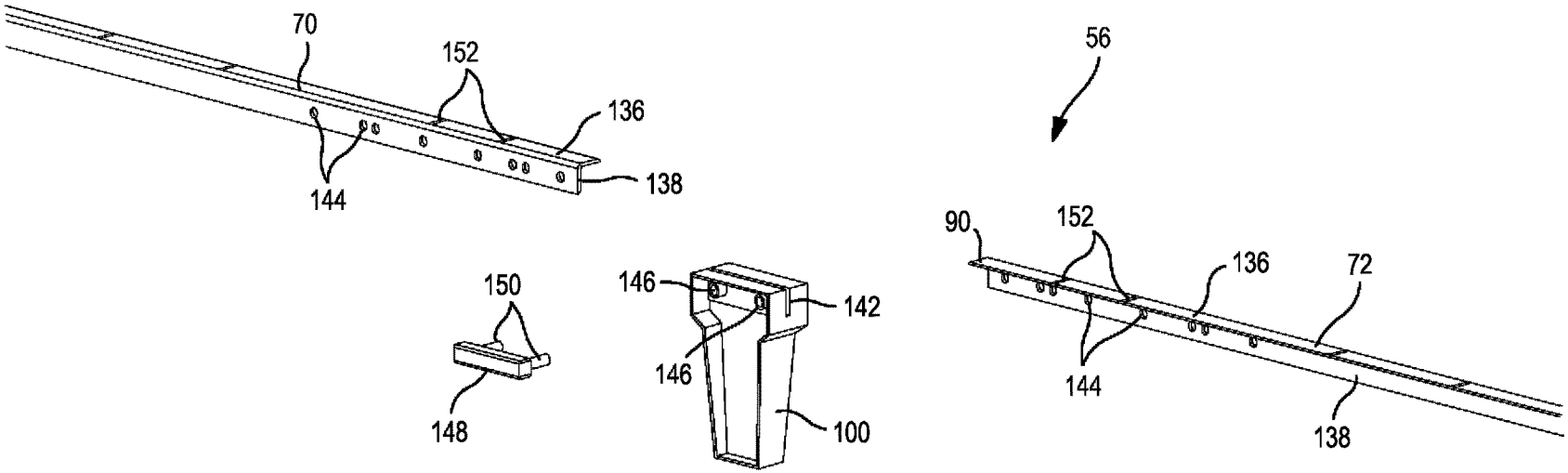
FIG. 4 is an exploded view showing the connection between the cross rail components in forming a cross rail of the FIG. 1 embodiment.

Turning next to FIG. 4, taken along with FIGS. 1-3, there is an exploded view of one of the end cross rails 56 to illustrate the assembly of a cross rail; it being seen that the assembly of both of the end cross rails 56 and the center cross rail 58 are the same. As such, the end cross rail components 70, 72 are seen and which are L-shaped angle irons with a horizontal flange 136 and a vertical flange 138. The end cross rail leg 100 has a slot 142 formed therein that is dimensioned to be wide enough to allow the insertion of two vertical flanges 138 in a side by side relationship as shown in FIG. 1.

As such, when the end cross rail components 70, 72 are overlapped in the manner as shown in FIG. 1, the vertical flanges 138 are positioned back to back and both can be inserted into the slot 142 with the horizontal flanges 136 extending outwardly for support to the box spring and bedding.

As also can be seen, in FIG. 4, there are a number of spaced apart holes 144 in each of the end cross rail components 70, 72 and two foot holes 146 in the end cross rail leg 100. Thus, when the end cross rail components 70, 72 are overlapped and aligned, four of the holes 144 will be in alignment with each of the end cross rail components 70, 72 such that a securing member 148 having two prongs 150 spaced a predetermined distance apart, can be inserted through the foot leg holes 146 and also an aligned pair of spaced apart holes 144 so that the end cross rail components 70, 72 are secured firmly to the end cross rail leg 100.

The user can easily determine when the proper pair of holes 144 are in alignment and that determination will depend on the particular bed frame begin assembled, that is, a queen, king size etc. In order for the user to properly align the holes 144, there are markings or indicia 152 provided on the upper surface of the end cross rail components 70, 72 so that the user can, for example, line up the inner end 90 of the end cross rail component 72 with the particular markings 152 on the upper surface of the other end cross rail component 70 and the pair of holes for that particular bed frame size will automatically be in alignment with the foot holes 146 such that the securing member 148 can be inserted through the leg holes 146 and through the holes 144 in both of the end cross rail components 70, 72.

Figure 5:
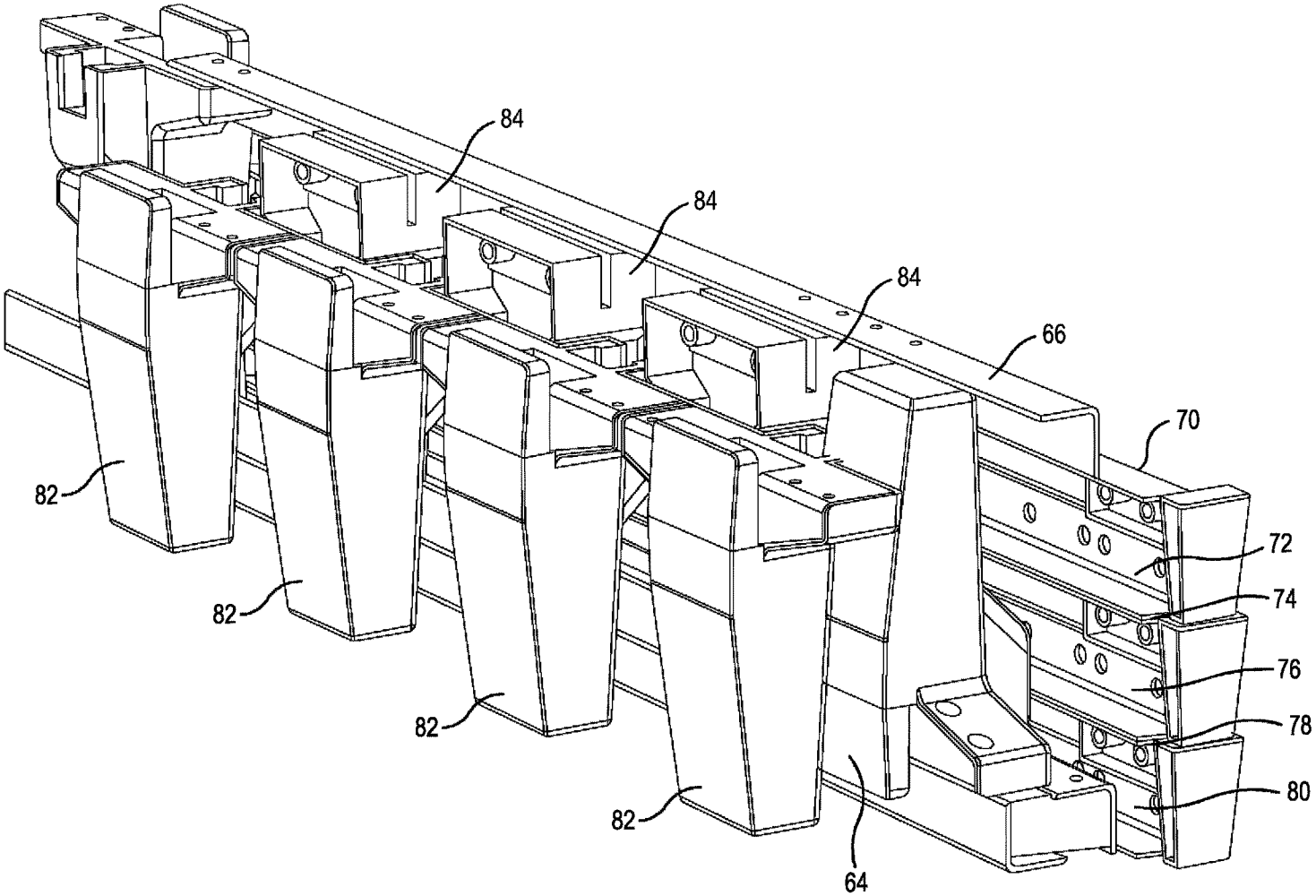
FIG. 5 is a perspective view showing the components of the bed frame of FIG. 1 configured for a compact, easily handled package.

Turning then to FIG. 5, there is a perspective view showing the components of the bed frame 50 of FIG. 1 configured for a compact, easily handled package that facilitates shipment or other transportation thereof, including the carrying of the package to a user's car for delivery to their home. Accordingly, the individual components can be seen, that is the side rail end legs 82, the side rail middle legs 84, the end cross rail components 70, 72, 74, 76, the first side rail components 60, 62, second side rail components 64, 66 and center cross rail components 78, 80. As can be seen, the components can be compactly configured for a package and the entire length is manageable and is about the length of half of a normal side rail of a comparable bed frame with a full length side rail, thus making the eventual package easy to carry or ship.

Figure 6:
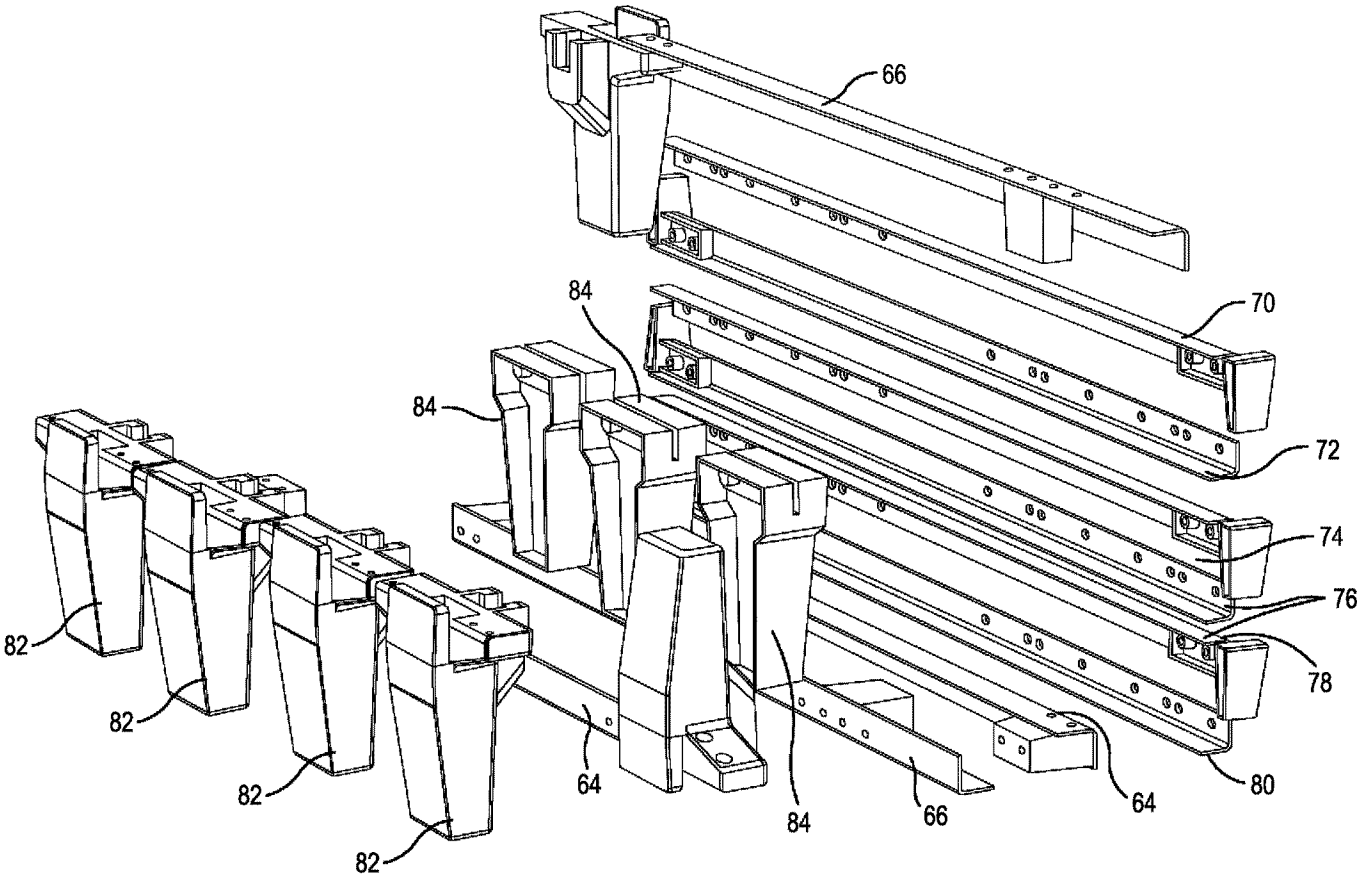
FIG. 6 is an exploded view illustrating the arrangement of the bed frame components of FIG. 5 adapted to be fit into a package.

Turning to FIG. 6, there is an exploded view illustrating the assembly of the individual components of FIG. 5.

In FIGS. 7 and 8, there is shown a perspective view and an exploded view of a bed frame 154 that is constructed in accordance with a second embodiment of the present invention. The second embodiment is very similar to the first embodiment shown in FIGS. 1-6 and includes two side rails 156, 158 that are attached to three cross rails, that is, end cross rails 160 and center cross rail 162. The side rails 156, 158 themselves, are comprised of first and second side rail components 164, 166, 168, 170, respectively. The same is true of end cross rails 160 and center cross rail 162 that are, respectively comprised of end cross rail components 172, 174, 176, 178 and center cross rail components 180, 182.

As with the prior embodiment, there are side rail end legs 184 and side rail center legs 186. As will become clear, the second side rail components 168, 170 are factory affixed to the side rail center legs 186. The first side rail components 164, 166 are affixed between the side rail center legs 186 and a pair of the side rail end legs 184 in a manner, again, which does not require any tools.

In the exploded view of FIG. 8, there can be seen the second side rail components 168, 170 with one end affixed to the side rail center legs 186 and have free ends 188. The first and second side rail components 164, 166, 168, 170 are preferably L-shaped angle irons with a flat horizontal flange and a vertical flange extending downwardly. Again, there are wedges 190, similar to those of the first embodiment, and which interfit into receivers 192 in the side rail end legs 184 and side rail center legs 186 in order to assemble the bed frame 154.

Also, there are small wedges 194 at the ends of the end cross rail components 172, 174, 176, 178 and center cross rail components 180, 182 to attach the end cross rails 160 and center cross rail 162 to the side rails 156, 158 by means of slots 192. Again, cross rail legs 198 are present to support the cross rails 160, 162.

In this embodiment, however the center cross rail components 180 and 182 as well as the end cross rail components 172, 174, 176, 178 are all pivotally affixed to the cross rail legs 198.

Turning to FIG. 9, taken along with FIGS. 7 and 8, there is a side view of center cross rail 162 and illustrating the connection between the center cross rail components 180, 182 and the cross rail leg 198, as exemplary of the connections to the cross rails legs 198 of end cross rail components 172, 174, 176, 178. In FIG. 7, the cross rail components 180, 182 are in an end to end orientation and thus is dimensioned so as to span the distance between the side rails 156, 158.

In FIG. 9 it can be seen that the center cross rail components 180, 182 are pivotally affixed to the cross rail leg 198 by means of pivot pins 200 so that each of the center cross rail components 180, 182 is free to pivot about the cross rail leg 198. In FIG. 9, cross rail component 180 has been pivoted 90 degrees from the end to end, horizontal orientation of FIGS. 7-8. The pivoting about the cross rail leg 198 is limited by the contact between a flange 202 on the center cross rail component 180 and a notch 204 formed in the cross rail leg 198.

The upward pivoting of each center cross rail component 180, 182 is also limited by the contact between pivot fitting 206 and an upper vertical surface 208 of the cross rail leg 198 so that the total pivoting movement of either of the center cross rail components 180, 182 is limited to movement between the horizontal orientation as shown in FIGS. 7-8, and the 90 degree pivoted movement to the vertical orientation of cross rail component 182 of FIG. 9.

In FIG. 10, both of the center cross rail components 180, 182 have been pivoted from the end to end orientation of FIG. 7 such that the center cross rail components 180, 182 are in a side by side position, thereby effectively reducing the overall length of the of center cross rail 162 to about half its end to end length of FIG. 7. Thus the cross rail components 180, 182, as well as the other cross rail components, can be pivoted between an orientation where they are end to end or horizontal and a side by side orientation where the cross rail components 180, 182 are parallel to each other.

In the tool-less assembly of the embodiment of bed frame 154, the side rails 156, 158 are assembled in the same manner as with the first embodiment illustrated and explained with respect to FIGS. 1-6. The main difference, however, between the first and second embodiments is that the end cross rails 160 and center cross rail 162 must be unfolded from their side to side orientation of FIG. 10 to their end to end orientation as shown in FIG. 7 so that the cross rails 160, 162 can be dropped into the assembled position as shown in FIG. 7 by simply dropping the small wedges 194 into the slots 196 and, like the first embodiment, the bed fame 154 of the second embodiment can be entirely assembled without the need for tools.

Turning then to FIG. 11, there is a perspective view showing the components of the bed frame 154 of FIGS. 7 and 8 configured for a compact, easily handled package that facilitates shipment or other transportation thereof, including the carrying of the package to a user's car for delivery to their home. Accordingly, the individual components can be seen, that is the side rail end legs 184, the side rail middle legs 186, the end cross rails 160 and the center cross rails 162 and side rail components 164, 166, 168, 170. As can be seen, the components can be compactly configured for a package and the entire length is manageable and is about the length of half of a normal side rail of a comparable bed frame with a full length side rail, thus making the eventual package easy to carry or ship.

Turning to FIG. 12, there is an exploded view illustrating the assembly of the individual components of FIG. 11.

In FIGS. 13 and 14, there is shown a perspective view and an exploded view of a bed frame 210 that is constructed in accordance with a third embodiment of the present invention. The third embodiment is very similar to the first and second embodiments shown in FIGS. 1-12 and includes two side rails 212, 214 that are attached to three cross rails, that is, end cross rails 160 and center cross rail 162. As will be seen, the end cross rails 160 and center cross rail 162 are the same as described with respect to the second embodiment of FIGS. 7-12 and, therefore, the same identification numbers are used to describe the end cross rails 160 and the center cross rail 162 as used in describing that embodiment.

In this embodiment, however, the side rails 212, 214 are made up of first and second side rail components 216, 218, 220 and 222, respectively. The same is true of end cross rails 160 and center cross rail 162 that are, respectively comprised of end cross rail components 172, 174, 176, 178 and center cross rail components 180, 182.

There are also side rail end legs 224 and side rail center legs 226. In this embodiment, the side rail end legs 224 are pre-connected to the first and second side rail components 216, 218, 220 and 222 by the manufacturer in a manner to be explained.

As can be seen in FIGS. 13 and 14, taking side rail 212 as an example of both side rails, 212 and 214, it can be seen that the first side rail component 216 has an inner end 228 that is pivotally affixed to the side rail center leg 226 about a pivot point 230. The same is true of the second side rail component 220 that has an inner end 232 that is pivotally affixed to the side rail center leg 226 about a pivot point 234. The outer ends 236, 238 of the first and second side rail components 216, 220, respectively, are affixed to the side rail end legs 224 and may be affixed thereto by securing devices 240, such as rivets.

The construction of the other side rail 214 is the same and, again, the first and second side rail components 218, 222 are pivotally affixed to the side rail center leg 226 about pivot points 242 and 244 and the outer ends 246 and 248 are affixed to the side rail end legs 224 and may be affixed thereto by securing devices 240, such as rivets.

Turning to FIG. 15, taken along with FIGS. 13 and 14, there can be seen the side rail 212 and which is constructed the same as side rail 214. In FIG. 15, the first and second side rail components 216 and 220 are in an end to end relationship where the resulting side rail 212 is a straight component and suitable for assembly into the bed frame 210. As can also be seen in FIG. 15, each of the side rail end legs 224 and the side rail center leg 226 include slots 248 that, as previously explained are receptive to the insertion of the small wedges 194 on the end cross rails 160 and center cross rail 162.

Turning then to FIG. 16, taken along with FIGS. 13-15, there is shown a perspective view of the side rail 212 and illustrating the pivoting connections between first and second side rail components 216 and 220. Accordingly, as can be seen, the first and second side rail components 216, 220 are pivotally affixed to the side rail center leg 226 by means of pivot points 230, 234 so that each of the side rail components 216, 220 are free to pivot about the side rail center leg 226.

In FIG. 17, the first and second side rail components 216, 220 have been pivoted 90 degrees from the end to end, straight orientation of FIG. 15 and are in a side by side or parallel relationship.

The pivoting about the side rail center leg 226 is limited by the contact between the first and second side rail components 216, 220 so that the pivoting of the first and second side real components 216, 220 are limited to the end to end position of FIG. 15 and the side by side, or parallel position of FIG. 17. In FIG. 17, it should be noted that the side rail end legs 224 are off set laterally along the first and second side rail components 216, 220 so that the first and second side rail components 216, 220 can be positioned in a close side to by side relationship and the side rail end legs 224 do not encounter each other.

Again, the assembly of the bed frame 210 of the third embodiment is basically the same as with the first two embodiments with the exception that the side rails 212, 214 are pivotally assembled so that the first and second side rail components 216, 218, 220 and 222 are in the end to end position of FIG. 15 so that the end cross rails 160 and center cross rail 162 can be dropped into position and be attached to the side rails 212, 214 by inserting the small wedges 194 into the slots 248 in the side rails 212, 214.

As with the first two embodiments, the assembly is carried out without the need for tools and can easily be carried out by person unskilled in the use of tools.

Turning then to FIG. 18, there is a perspective view showing the components of the bed frame 210 of FIGS. 13 and 14 configured for a compact, easily handled package that facilitates shipment or other transportation thereof, including the carrying of the package to a user's car for delivery to their home. Accordingly, the individual components can be seen, that is the side rails 212, 214 and the end and center cross rails 160, 162. As can be seen, the components can be compactly configured for a package and the entire length is manageable and is about the length of half of a normal side rail of a comparable bed frame with a full length side rail, thus making the eventual package easy to carry or ship.

Turning to FIG. 19, there is an exploded view illustrating the assembly of the individual components of FIG. 18.

In FIGS. 20 and 21, there is shown a perspective view and an exploded view of a bed frame 260 that is constructed in accordance with a fourth embodiment of the present invention. The fourth embodiment is very similar to the first three embodiments shown in FIGS. 1-19 and includes two side rails 212, 214 that are attached to three cross rails, that is, end cross rails 262 and center cross rail 264. The side rails 212, 214 are the same as described with respect to the third embodiment of FIGS. 13-19 and, therefore, the same identification numbers are used to describe the side rails 212, 214 as used in describing that embodiment.

Again, therefore, the side rails 212, 214 are made up of first and second side rail components 216, 218 and 220, 222, respectively, that are pivotally affixed to the side rail middle legs 226 and include side rail end legs 224 that are affixed to the free ends of the first and second side rail components 216, 218 and 220, 222. The end cross rails 262 are comprised of end cross rail components 278, 280, 282, 284 and the center cross rail 264 is comprised of center cross rail components 286, 288.

Turning to FIG. 22, taken along with FIGS. 20 and 21, there is a side view of the center cross rail 264 made up of center cross rail components 266, 268. The center cross rail 264 is specifically described, however, it can be seen that the end cross rails 262 are constructed in the same manner as center cross rail 264.

As can be seen, each of the center cross rail components 266 and 268 has inner ends 270, 272 and outer ends 274, 276. At the inner ends 270, 272 there is a double leg 286 extending downward so as to contact the floor or other planar surface when the bed frame is assembled and ready for use. As such, the double leg 286 has a bottom end 288 for contacting that supporting surface to support the bed frame 260 and an upper end 289.

Each of the center cross rail components 266, 268 is pivotally affixed to the double leg 286 about pivot points 290. As also can be seen, the lateral surfaces 292 and 294 of the upper end 289 of the double leg 286 is rounded to enable a horizontal flange on each of the center cross rail components 266, 268 to rotate with respect to the double leg 286.

Thus, the center cross rail components 266, 268 both may be L-shaped or T-shaped and can be pivoted about the pivot points 290 so that the center cross rail components 266, 268 can rotate without interference from the horizontal flange.

Turning to FIG. 23, there is a perspective view illustrating the rotation of the center cross rail components 266 and 268. As can be seen, the center cross rail component 268 has been rotated to a position where it is parallel to the double leg 286 while the center cross rail component 266 is partially rotated from its position where the center cross rail components 266, 268 form an end to end straight line relationship with respect to each other to the position as shown in FIG. 22.

In FIG. 24, there is a side view of the center cross rail 264 where both of the center cross rail components 266, 268 have been moved to a position where they are essentially parallel with respect to each other and displaced about 90 degrees from the working orientation of FIG. 22. There also can be seen wedge connectors 296 at the outer ends 274, 276 of each of the center cross rail components 266 and 268.

Turning then to FIG. 25, there is an enlarged, perspective view of the distal end 276 of the center cross rail component 268 and showing the wedge connector 296. The wedge connector 296 can be affixed to the distal end 276 of the center cross rail component 268 by means of a pair of flanges 298 secured together with fasteners 300, such as rivets, so as to sandwich the vertical flange 302 of the center cross rail component 268 therebetween.

A wedge 304 extends downwardly from the flanges 298 and wedge 304 comprises a flexible tab 306 with a bottom edge 308 that extends inwardly toward the inner end 270 of the center cross rail component 268.

Turning next to FIG. 26, there is an exploded view, taken from below, illustrating the connection between the center cross rail component 268 and a side rail center leg 226. As can be seen, the side rail center leg 226 has a slot 310 formed therein with an open bottom 312. The dimensions of the slot 310 are sized to receive the wedge 304 so that the center cross rail component 268 can be attached to the side rail center leg 226 by simply dropping the wedge 304 into the slot 310.

In FIG. 27, taken along with FIG. 26, there is a perspective view illustrated the completed connection between the center cross rail component 268 and the side rail center leg 226. In FIG. 27, the wedge 304 has been inserted downwardly into the slot 310 and the bottom edge 308 projects outwardly so as to latch against the bottom of the wedge connector 296. The wedge 304 cannot be removed from the slot 310 without first moving the bottom edge 308 of the flexible tab 306 outwardly to unlock the center cross rail component 268 from the side rail center leg 226.

As with the first three embodiments, the assembly is carried out without the need for tools and can easily be carried out by an unskilled person.

Turning then to FIG. 28, there is a perspective view showing the components of the bed frame 260 of FIGS. 20 and 21 configured for a compact, easily handled package that facilitates shipment or other transportation thereof, including the carrying of the package to a user's car for delivery to their home. Accordingly, the individual components can be seen, that is the end cross rails 262, center cross rail 264 and side rails 212, 214. As can be seen, the components can be compactly configured for a package and the entire length is manageable and is about the length of half of a normal side rail of a comparable bed frame with a full length side rail, thus making the eventual package easy to carry or ship.

Turning to FIG. 29, there is an exploded view of the package of FIG. 28 illustrating the assembly of that package and the location and assembly of the individual components.

In FIGS. 30 and 31, there is shown a perspective view and an exploded view of a bed frame 320 that is constructed in accordance with the present invention and includes a locking system to be described. As can be seen, the bed frame 320 includes two side rails 322 and 324 that are attached to three cross rails, that is, end cross rails 326 and center cross rail 328. Basically, the end cross rails 326 and center cross rail 328 are similar to the end cross rail and center cross rails previously described with respect to the prior embodiments of FIGS. 1-29, however a locking system is employed with the side rails 322, 324 to allow the first side rail components 330, 332 and second side rail components 334 and 336 to pivot in forming the side rails 322, 324 and be locked into their orientation where the first side rail components 330, 332 and second side rail components 334, 336 are oriented end to end.

Again, the end cross rails 326 and center cross rail 328 are, respectively comprised of end cross rail components 338, 340, 342 and 344 and center cross rail components 346 and 348.

There are also side rail end legs 350 and side rail center legs 352 as well as end and center cross rail legs 354. In this embodiment, the side rail end legs 350 are pre-connected to the first side rail components 330, 332 and second side rail components 334, 336 by the manufacturer.

In FIGS. 32 and 33, there are side views of a center cross rail 328 in the end to end and parallel orientations. As seen, the end cross rails 326 and center cross rail 328 are basically the same and, in FIG. 32, the center cross rail 328 is illustrated. The center cross rail components 346 and 348 pivot about the center rail leg 354. When the center cross rail 328, for example, is disassembled or prior to assembly, the center cross rail components 346 and 348 are essentially parallel to each other as shown in FIG. 33 in the collapsed orientation where the center cross rail 328 is readily shipped or stored. The small wedges 356 are affixed to the distal ends of the center cross rail components 346, 348, as well as the end cross rails 326, and are aligned and abut against each other.

As also can be seen in FIG. 32, there is a U-shaped saddle 349, preferable formed of metal, that joins the cross rail components 346, 348 and provides the pivot points for those components. The U-shaped saddle 349 can be a one piece construction or, preferably, can be comprised of two metal pieces joined together by rivets to form the U-shaped saddle with an internal space.. As such, the saddle 349 can be a metal so as to provide a strong junction of the cross rail components 346, 348 and the plastic center rail leg 354 and, in manufacture of the bed frame 320, the plastic center rail leg 354 can be added later to the saddle 349. The saddle type of construction is also used with the end cross rails 326 as well as the side rails 322, 324 as will be seen.

Turning then to FIG. 34, there is a perspective view of the side rail 322, the other side rail 324 being identical. As can be seen, the first side rail component 330 and the second side rail component 332 both have inner ends 358 pivotally affixed together supported by a side rail center leg 352 in a manner to be described.

The outer ends 360 of the first and second side rail components 330, 332, respectively, are affixed to the side rail end legs 350 and may be affixed thereto by securing devices such as rivets 362. As seen, the side rail end legs 350 and side rail center leg 352 have slots 364, 366 respectively to receive the small wedges 356 at the ends of the end cross rails 326 and center cross rail 328 (FIG. 2).

Turning then to FIG. 35, there is shown a side view of side rail 322 with the first side rail component 330 and the second side rail component 334 pivotally joined together. Again a metal U-shaped saddle 368 is used for the connection and include pivot points, such as pivot pins 370 located in the saddle 368 that pass through holes, not shown, in each of the first and second side rail components 330, 334. At the inner ends 358 of the first and second rail components 330, 334, there are notches 372, 374 formed, respectively, in the first side rail component 330 and the second side rail component 334 to serve a purpose to be explained.

In the upper portion of the saddle 368, there is a slot 376 formed and a pair of sliding pins 378, 380 slide along that slot 376 and their outward lateral movement is constrained by the slot 376. A V-shaped spring 382 is shown and contacts the sliding pins 378, 380 to bias those sliding pins 378, 380 inwardly as shown in the FIG. 35, that is, away from the notches 372, 374. In an exemplary embodiment there are two V-shaped springs, spaced apart, and they are floating springs, that is, they are connected to the sliding pins 378, 380 only by their ends 379 and 381 encircling the sliding pins 378 and 380 to bias the sliding pins 378 and 380 inwardly toward each other.

In addition, there is a plastic separator 384 that moves upwardly and downwardly within the U-shaped saddle 368 and the separator 384 also has a spring 386 extending downwardly into the saddle 368. The plastic separator 384 is shown in its upper position in FIG. 35 so that no spring bias is exerted against the sliding pins 378, 380 by the spring 386. As also seen in FIG. 35, the first and second side rail components 330, 334 and in an unlocked position, angle away from each other and, in the unlocked position, can be freely pivoted about the pivot pins 370.

Turning then to FIG. 36, the same structure is shown, however, the first and second side rail components 330, 334 have been pivoted into an end to end alignment so as to make up the side rail 322 used with the bed frame 320.

Next, in FIG. 37, taken with FIGS. 35 and 36, the separator 384 has been moved to its lower position within the U-shaped saddle 368 and the spring 386 is in contact with the sliding pins 378, 380. As seen, the first side rail component 330 is now in a locked position and the sliding pin 378 has moved in to the notch 372 by mean of the bias exerted by the spring 386 against the sliding pin 378 that biases the sliding pin 378 outwardly, toward the slot 376. As such, the first side rail component 330 is securely locked into its operative position within saddle 368. The second side rail component 334 is still angled outwardly and thereof is not in its locked position.

In FIG. 38, it can be seen that both the first and second side rail components 330, 334 are in the locked position and the sliding pins 378, 380 both are engaged in the slots 372, 372, thereby locking the side rail components 330 and 334 in position where they are oriented end to end and thus make up the side rail 322.

As can be seen, to disengage the first and second side rail components 330, 334 again, the separator 384 can simply be moved to its upper position and the outward bias exerted on the sliding pins 378, 380 by spring 386 is removed, thereby allowing the inward bias of the V-shaped spring to move the sliding pins 378, 380 inwardly and disengage from the notches 372, 374.

Turning to FIG. 39, it can be seen that the first and second side rail components 330, 334 have been pivoted to their orientation where they are generally parallel to each other and thus take up less room for storage or shipping.

Next, in FIG. 40, there is shown an exploded view of the side rail 322 collapsed for storing or shipping and illustrating the various components that can be made manageable by pivoting the first and second side rail components 330, 334 to an orientation where they are generally parallel to each other.

With the locking system herein disclosed, the locking sys is illustrated as incorporated into the side rails for illustration purposes, however, it will be seen that the same locking system is applicable for use on cross rails as well as side rails and gain the same advantages.

In addition, it is noted that with the aforedescribed embodiments, both the side rails and the cross rails may be T-shaped and be comprised of two L-shaped angle irons affixed together or a unitary T-shaped construction.

While the present invention has been set forth in terms of a specific embodiment or embodiments, it will be understood that the present folded bed frame herein disclosed may be modified or altered by those skilled in the art to other configurations. Accordingly, the invention is to be broadly construed and limited only by the scope and spirit of the claims appended hereto.

What is claimed is:

1. A bed frame assembly for supporting a mattress or mattress set, the bed frame assembly comprising: a pair of side rails, each side rail having side rail end legs and a side rail center leg, said side rail end legs and said side rail center leg each having side rail receivers formed therein, and at least three cross rails, wherein each side rail comprises two side rail components having inner ends and outer ends, the inner end of one side rail component of each side rail being affixed to the inner end of the other side rail component, the inner end of one side rail component having a wedge that is adapted to fit into the side rail receiver of the side rail center leg, wherein the side rail components of each side rail is configured to be connected and disconnected from each other without the use of tools, wherein the at least three cross rails each comprise two cross rail components, each cross rail component having an inner end and an outer end, the outer ends of each cross rail component having a wedge affixed thereto, wherein the inner ends of the cross rail components are pivotally supported by a cross rail leg with a pivoting affixation via two pivot pins and wherein each of the cross rail components is fitted with one of the two pivot pins, and wherein the pivoting affixation allows the cross rail components to be moved between a first position where the cross rail components are essentially parallel to each other with the wedges at the outer ends being adjacently juxtaposed and a second position wherein the cross rail components are in a straight end to end position.

2. The bed frame assembly of claim 1 wherein the assembly includes corner legs having side rail receivers formed therein and the outer ends of each side rail component has a wedge that is configured to be inserted into the side rail receivers in the corner legs to affix the corner legs to each end of the side rails.

3. The bed frame assembly of claim 1 wherein movement between the first and second positions is constrained by the center leg.

4. A bed frame assembly for supporting a mattress or mattress set, the bed frame assembly comprising:

a pair of side rails comprising opposed side rail end legs and a side rail center leg, each of the pair of side rails having side rail components, each of the side rail components having an inner end and an outer end; and three cross rail members, each having a cross rail center leg;

wherein each side rail comprises two side rail components having the inner ends pivotably joined together at the side rail center legs whereby the two side rail components are configured to be manipulated between a first side rail position wherein the ends of the side rail components are positioned end to end to form the side rail and a second side rail position wherein the ends of the side rail components are in a side by side position, wherein each cross rail comprises two cross rail components having ends joined pivotably together at the cross rail center leg whereby the two cross rail components are configured to be manipulated between a first cross rail position wherein the ends of cross rail components are positioned end to end to form the cross rail and a second cross rail position wherein the cross rail components are in a side by side position, wherein each of the three cross members has outer ends having wedges that are configured to be fitted directly into receivers formed in the side rail end and center legs, wherein the inner ends of each of the side rail components are pivotally secured to the side rail center leg, wherein the outer ends of each of the side rail components are adjacently juxtaposed in the second side rail position, wherein a plane defined by longitudinal extents of the side rail components in the first side rail position is different from a plane defined by longitudinal extents of the side rail components in the second side rail position, and wherein, when the two side rail components are in the first side rail position, when the cross rail components are in the first cross rail position, and when the wedges of the three cross rail members are fitted in the receivers of the side rail end and center legs, the orientation of the pair of side rails and the three cross rail members are locked in orientation to prohibit rotational movement thereof.

5. The bed frame assembly of claim 4 wherein the outer ends of the side rail components are affixed to corresponding side rail end legs.

6. The bed frame assembly of claim 4 wherein the outer ends of the side rail components are affixed to corresponding side rail end legs via rivets.

7. The bed frame assembly of claim 4 wherein the receivers comprise slots formed in the upper portion of the side rail end legs and in the side rail center legs.

8. The bed frame assembly of claim 4 wherein the wedges of the three cross members are configured to be non-pivotably fixed into the receivers at the side rail end legs and at side rail center legs.

* * * * *